US010317088B2

(12) United States Patent
Lona Santoyo et al.

(10) Patent No.: US 10,317,088 B2
(45) Date of Patent: Jun. 11, 2019

(54) TRIPLE RING FLAME BURNER

(71) Applicant: MABE, S.A. DE C.V., Santiago de Queretaro (MX)

(72) Inventors: José Arturo Lona Santoyo, Santiago de Queretaro (MX); Noé Araujo Monsalvo, Santiago de Queretaro (MX)

(73) Assignee: MABE, S.A. DE C.V., Queretaro (MX)

( * ) Notice: Subject to any disclaimer, the term of this patent is extended or adjusted under 35 U.S.C. 154(b) by 300 days.

(21) Appl. No.: 15/200,170

(22) Filed: Jul. 1, 2016

(65) Prior Publication Data

US 2017/0003033 A1 Jan. 5, 2017

(30) Foreign Application Priority Data

Jul. 2, 2015 (MX) ..... MX/a/2015/008660

(51) Int. Cl.

| | |
|---|---|
| ***F23K 5/00*** | (2006.01) |
| ***F23D 14/06*** | (2006.01) |
| ***F24C 3/08*** | (2006.01) |
| ***F24C 3/12*** | (2006.01) |
| ***F23D 14/02*** | (2006.01) |

(52) U.S. Cl.

CPC ..... *F24C 3/124* (2013.01); *F23D 14/02* (2013.01); *F23D 14/06* (2013.01); *F23K 5/002* (2013.01); *F24C 3/085* (2013.01); *F23D 2900/14062* (2013.01)

(58) Field of Classification Search

CPC ..... F23D 14/02; F23D 14/06; F23K 5/002; F24C 3/12

USPC ..... 126/39 E, 39 R, 39 BA; 431/284, 278, 431/354

See application file for complete search history.

(56) References Cited

U.S. PATENT DOCUMENTS

| | | | | |
|---|---|---|---|---|
| 2,162,233 | A | 6/1939 | Schoenberger | |
| 2,891,608 | A | 6/1959 | Mueller | |
| 5,277,576 | A | 1/1994 | Hartung et al. | |
| 6,325,619 | B2 | 12/2001 | Dane | |
| 6,695,954 | B2 * | 2/2004 | Hong | H01J 37/32082 204/192.1 |

(Continued)

FOREIGN PATENT DOCUMENTS

| | | |
|---|---|---|
| CN | 2793563 | 7/2006 |
| CN | 2893434 | 4/2007 |

(Continued)

*Primary Examiner* — Gregory L Huson
*Assistant Examiner* — Nikhil P Mashruwala
(74) *Attorney, Agent, or Firm* — Terry M. Sanks, Esq.; Beusse Wolter Sanks & Maire, PLLC

(57) ABSTRACT

A triple ring flame burner composed of a central burner and a toroidal burner that are coupled by a bridge, the central burner comprises a Venturi tube, a mixture chamber, a distribution channel with the toroidal burner composed of a second Venturi tube, a second mixture chamber, a second distribution channel, a stability and flame transfer chamber with a pair of radial walls which divide the distribution channel from the inner crenellated wall to the outer crenellated wall, said radial walls present a plurality of combustion ports that transfer the flame inserted within said radial walls, the inner of the radial walls is in connection with a peripheral crenel for inner stability and transfer and the outer end of the radial walls is in connection with at least one peripheral crenel for outer stability and transfer.

12 Claims, 21 Drawing Sheets

(56) References Cited

U.S. PATENT DOCUMENTS

| | | | | |
|---|---|---|---|---|
| 8,221,116 | B2 * | 7/2012 | Biagioli | F23D 14/065 126/39 BA |
| 8,747,108 | B2 * | 6/2014 | Lona Santoyo | F23D 14/06 126/39 B |
| 8,932,049 | B2 * | 1/2015 | Ryu | F23D 14/06 126/39 E |
| 9,255,710 | B2 * | 2/2016 | Cadima | F23D 14/06 |
| 9,664,394 | B2 * | 5/2017 | Cadima | F23D 14/84 |
| 9,677,768 | B2 * | 6/2017 | Cadima | F24C 3/08 |
| 9,810,436 | B2 * | 11/2017 | Mayberry | F24C 3/12 |
| 9,995,482 | B2 * | 6/2018 | Cadima | F23D 14/84 |
| 2001/0010897 | A1 | 8/2001 | Dane | |
| 2007/0141521 | A1 | 6/2007 | Armanni | |
| 2008/0206697 | A1 | 8/2008 | Trochou | |
| 2010/0206293 | A1 | 8/2010 | Padgett et al. | |
| 2010/0319677 | A1 | 12/2010 | Lacche | |
| 2011/0151385 | A1 | 6/2011 | Lona Santoyo et al. | |
| 2013/0059256 | A1 | 3/2013 | Cadeau et al. | |
| 2016/0263327 | A1 * | 9/2016 | Radmer | A61M 5/20 |
| 2017/0023245 | A1 * | 1/2017 | Araujo Monsalvo | F23D 14/20 |
| 2017/0370576 | A1 * | 12/2017 | Fang | F23D 14/58 |
| 2018/0106476 | A1 * | 4/2018 | Breccia | F23D 14/065 |

FOREIGN PATENT DOCUMENTS

| | | |
|---|---|---|
| EP | 485645 | 5/1992 |
| EP | 1649216 | 5/2009 |
| EP | 2226560 | 9/2010 |
| EP | 1714075 | 7/2012 |
| EP | 2629010 | 8/2013 |
| EP | 1781989 | 12/2015 |
| EP | 1875132 | 6/2016 |
| EP | 1714076 | 10/2016 |
| ES | 2379029 | 4/2012 |
| WO | 9908046 | 2/1999 |
| WO | 2003036168 | 5/2003 |
| WO | 2004044490 | 5/2004 |
| WO | 2005078342 | 8/2005 |
| WO | 2006005428 | 1/2006 |
| WO | 2006117815 | 11/2006 |
| WO | 2011104230 | 9/2011 |
| WO | 2011144491 | 11/2011 |
| WO | 2011144492 | 11/2011 |
| WO | 2012080051 | 6/2012 |

* cited by examiner

TRIPLE RING FLAME BURNER

CROSS-REFERENCE TO RELATED APPLICATIONS

This application claims priority to Mexican Patent Application No. MX/a/2015/008660 filed Jul. 2, 2016, and incorporated herein by reference in its entirety.

FIELD OF THE INVENTION

The present invention relates to a triple ring burner which allows activating in a selective manner all of the rings, a part thereof or at least one of the rings. Said burner is able to place different size receptacles over said burner, in such a way that if a small receptacle were to be placed, only one ring would be used, if a medium sized receptacle were to be placed, then two rings would be used and if a large sized receptacle were to be placed, then three rings would be used.

BACKGROUND

Currently in the market, a considerable amount of burners for household use are in existence, initially the main objective of these, was to make available a flame which would be cast on the utensils to be heated, without consideration to aspects regarding efficiency of use of the combustibles used or any ecological concerns; through the course of time, the design of burners has evolved towards triple flame burners, however, the energy efficiency of the same has not been taken into account.

Document MX2009014047, which belongs to the state of the art, anticipates a triple ring burner which comprises a burner head with a central ring, an intermediate ring and an outer ring, the central ring is found in communication with the intermediate ring by means of a plurality of bridges, said rings present a plurality of combustion ports, the ports of the outer rings are helicoid, causing the flames produced in said combustion ports to be inclined. Given that the combustion ports of the outer ring are helicoid, the flame darts produced by said combustion ports tend to separate themselves from the burner, which causes incorrect ignition for the combustible-air mixture, which in turn triggers the kitchen utensils placed over said burner to end up with soot.

U.S. Pat. No. 5,277,576, which belongs to the state of the art, anticipates a double ring burner comprising a burner head with a central ring and an outer ring, the central ring presents a plurality of horizontal combustion ports, while the outer ring presents a plurality of inclined combustion ports. Said burner does not anticipate that the central and outer rings be found interconnected by means of a plurality of bridges, similarly, it does not anticipate a flame ring found between the central ring and the outer ring, neither does it anticipate that the central combustion ports have an inclination, thereby achieving the same to be longer.

Document WO99/08046, which belongs to the state of the art, anticipates a triple ring burner comprising a burner head with a central ring, an intermediate ring and an outer ring, said rings present a plurality of combustion ports, the combustion ports are inclined, the inclination of the combustion ports of the intermediary ring is different from the inclination of the combustion ports of the central ring and those of the outer ring. However, given that the combustion ports are formed on the central and peripheral cover lids, combustible-air mixture leakage occurs at the joint of said cover lids with the central and peripheral bodies of said burner, thereby causing leaks of the combustible-air mixture, and therefore decreasing the energy efficiency of said burner.

Present invention seeks resolving the problems concerning the energy efficiency by means of structural modifications present in present invention.

BRIEF DESCRIPTION OF THE INVENTION

Present invention relates to a triple ring burner with flame comprising a central burner with a central cover lid and a toroidal burner with a toroidal cover lid, wherein the central burner is found coupled unto the toroidal burner by means of at least one bridge, said central burner comprises a first Venturi tube which receives and emits a first combustible-air pre-mixture for the central burner; a first mixture chamber which receives said first pre-mixture and homogenizes it, creating a first combustible-air mixture; a first distribution channel for distributing the first combustible-air mixture to a plurality of central combustion ports of said central burner; a circumferential groove set on said plurality of main central combustion ports in order to form a ring of flames; said toroidal burner comprises a second Venturi tube which receives and emits a second combustible-air pre-mixture; a second mixture chamber which receives said second pre-mixture and homogenizes it, creating a second combustible-air mixture; a second distribution channel for distributing the second combustible-air mixture; an inner crenellated wall and an outer crenellated wall, said crenellated walls are separated by the second distribution channel and with at least main combustion ports and secondary combustion ports; over the inner crenellated wall, at least one inner barrier rail with inner barrier rail combustion ports; over the outer crenellated wall, at least one outer barrier rail with outer barrier rail combustion ports; a flame stability and transfer chamber with a pair of radial walls which divide the distribution channel from the inner crenellated wall towards the outer crenellated wall, said radial walls present a plurality of transversal grooves which form combustion ports for the transfer of flame and are inserted into said radial walls; said radial walls present inner and outer ends, the inner end is in connection with a peripheral crenel for inner stability and transfer and the outer end is in connection with at least one peripheral crenel for outer stability and transfer.

BRIEF DESCRIPTION OF THE FIGURES

The illustrative embodiment may be described referencing the accompanying figures, which refer to.

DETAILED DESCRIPTION OF THE INVENTION

The following description references FIGS. 1 through 14.

The use of the term "approximately" provides an additional determined range. The term is defined in the following manner. The additional range provided by the term is +10%. By way of example, but not in a limitative manner, if it reads "approximately between 25° to 41°", the exact range is between 22.5° and 45.1°, or yet between 27.5° and 45.1°, or yet between 22.5° and 36.9° or between 27.5° and 36.9°. Any of the possibilities described above are covered through the use of the term "approximately".

Figure 1:
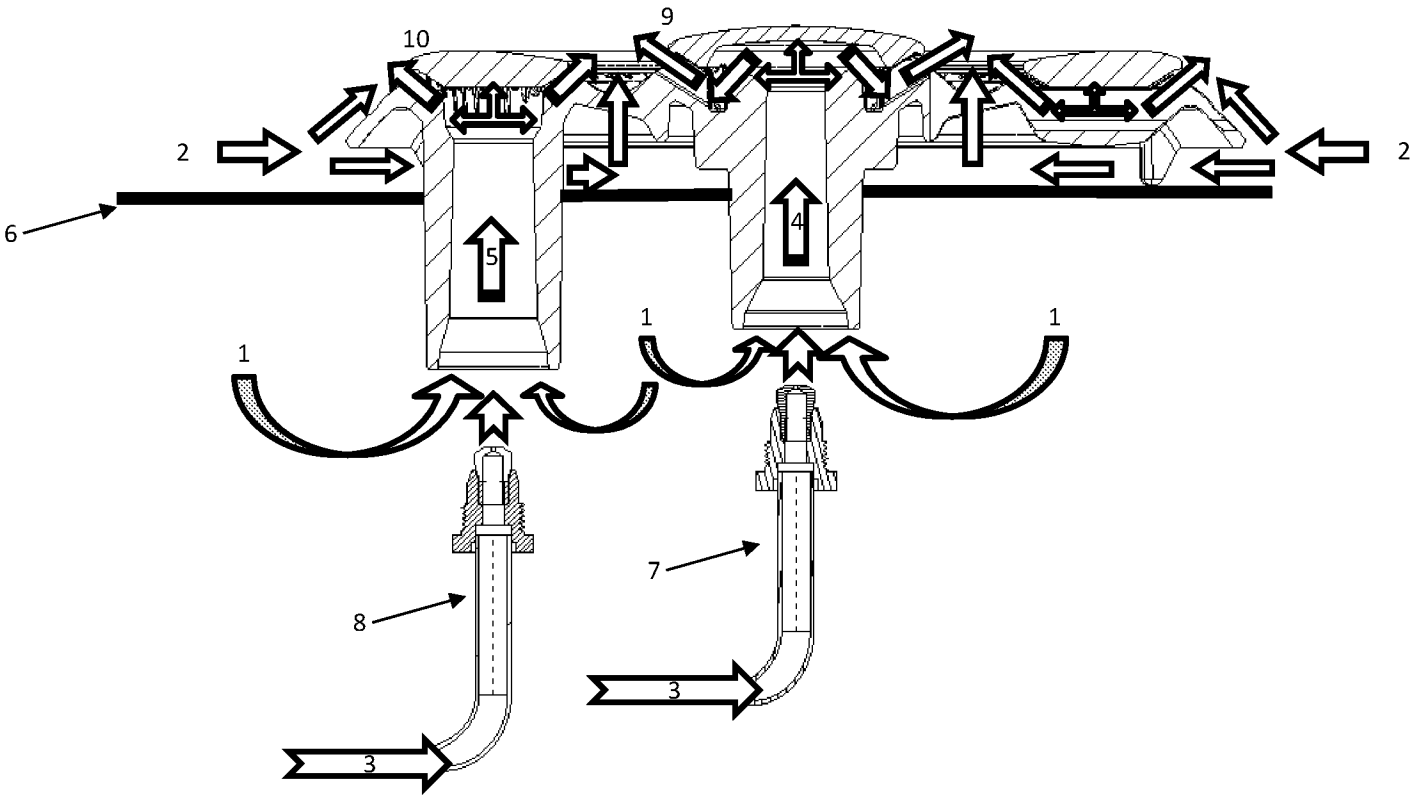
FIG. 1 shows the mass flow of the combustible-air mixture of the burner of present invention in detail.

In FIG. 1 a mass flow diagram of the burner of present invention is shown, both in the central burner (10) as well as in the toroidal burner (20).

We shall begin by explaining the functioning of the central burner (10), once the multiple selection valve (not shown) is activated, in such a way that it allows the flow of combustible (3) from a first nozzle and a first combustion port nozzle (7) towards a first Venturi tube (104), in such a way that due to the difference in velocities, the primary air (1) is dragged towards the inner part of said first Venturi tube (104), carrying out a first combustible-air (4) pre-mixture which presents a turbulent flow, said first combustible-air (4) pre-mixture which exits at a first velocity, is not sufficiently uniform to carry out an adequate dart flame ignition, so that the first combustible-air (4) pre-mixture continues its trajectory along the length of the first Venturi tube (104) and is expelled through the exit (103) of the first Venturi tube (104), in such a way that upon flowing out into the first mixture chamber (123), said first combustible-air (4) pre-mixture is homogenized in the surrounding areas close to the exit of the first Venturi tube (104), upon flowing from the same and knocking against the lower part of the central cover lid (40) which forms part of the first mixture chamber (123), where the first final mixture of the combustible-air (9) takes place at a second velocity for decelerating or decreasing the energy of the mixture, which helps decrease the energy of the first final combustible-air mixture (9) for avoiding flame detachment in the central combustion ports (115), afterwards it is distributed through the first distribution channel (106) to be dosed in a controlled manner in the combustion ports and undertake an adequate dart flame ignition, additionally, said dart flame is fed by secondary air (2) emanating from the environment surroundings.

Similarly, for the activating of the toroidal burner (2), the multiple selection valve (not shown) becomes activated for a second time, in such a manner that it allows for the flow of combustible (3) from a second nozzle and a second combustion port nozzle (8) towards a second Venturi tube (224), in such a way that due to the difference in velocities, the primary air (1) is dragged towards the inner part of said second Venturi tube (224), carrying out a second combustible-air (5) pre-mixture which presents a turbulent flow, said second combustible-air (5) pre-mixture which exits at a first velocity, is not sufficiently uniform to carry out an adequate dart flame ignition, so that the second combustible-air (5) pre-mixture continues its trajectory along the length of the second Venturi tube (224) and is expelled through the exit (223) of the second Venturi tube (224), in such a way that upon flowing out into the second mixture chamber (237), said second combustible-air (5) pre-mixture is homogenized in the surrounding areas close to the exit of the second Venturi tube (224), upon flowing from the same and knocking against the lower part of the toroidal cover lid (50) which forms part of the second mixture chamber (237), where the second final mixture of the combustible-air (10) takes place at a second velocity for decelerating or decreasing the energy of the mixture, and ingresses the barrier rails (225, 228) which help decrease the energy of mixture for avoiding flame detachment in the combustion ports near the second mixture chamber (237), afterwards it is distributed through the second distribution channel (205) to be dosed in a controlled manner in the combustion ports and undertake an adequate dart flame ignition, additionally, said dart flame is fed by secondary air (2) emanating from the environment surroundings.

Figure 2:
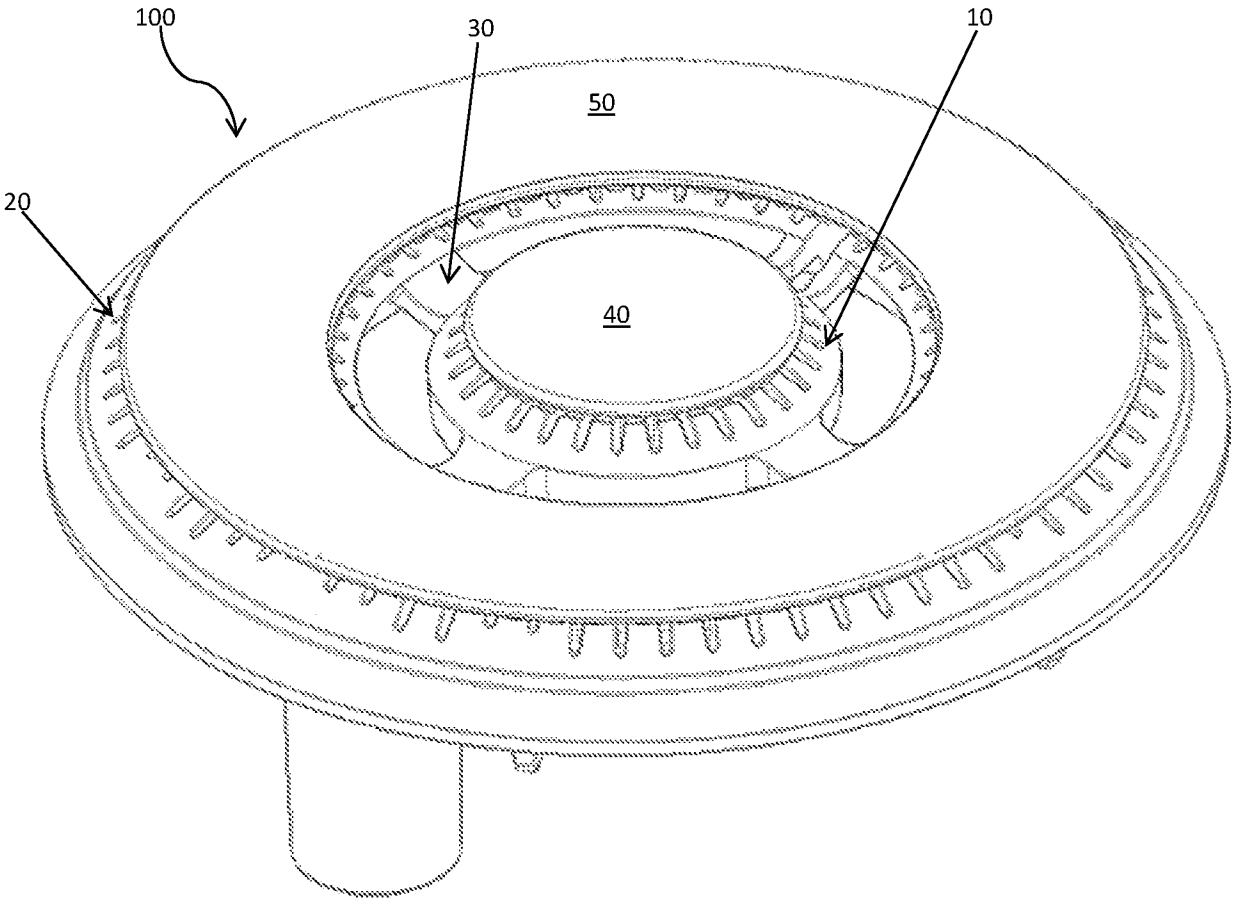
FIG. 2 shows a perspective view of the multiple flame burner.

In FIG. 2 it is possible to view the triple ring burner (100) of present invention, which comprises a central burner (10) with a single ring joined by means of at least one bridge (30) a double ring toroidal burner (20), in such a way that the multiple flame burner is found as a single piece, whether it is monolithic or integrated, in this case the term integrated refers to the central burner (10) with a single ring, said at least one bridge (30) and the double ring toroidal burner (20) are manufactured separately and later joined, while on the other hand, the term monolithic refers said elements having been manufactured as a single piece.

Over the central burner (10) with a single ring a central cover lid (40) is provided, while over the double ring toroidal burner (20) a toroidal cover lid (50) is provided.

Figure 3:
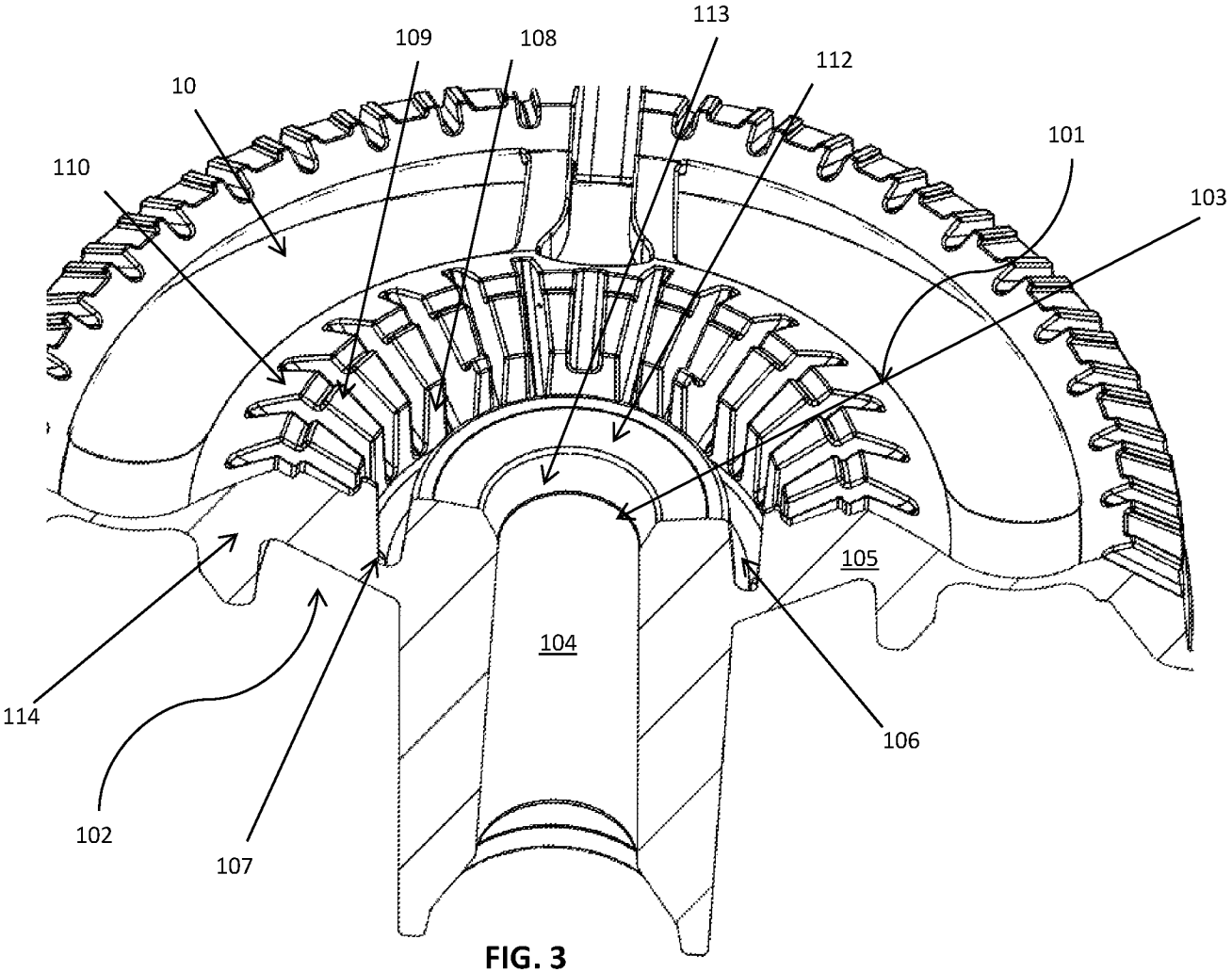
FIG. 3 shows a perspective view of the central burner with a single ring which forms part of the multiple flame burner.
Figure 3A:
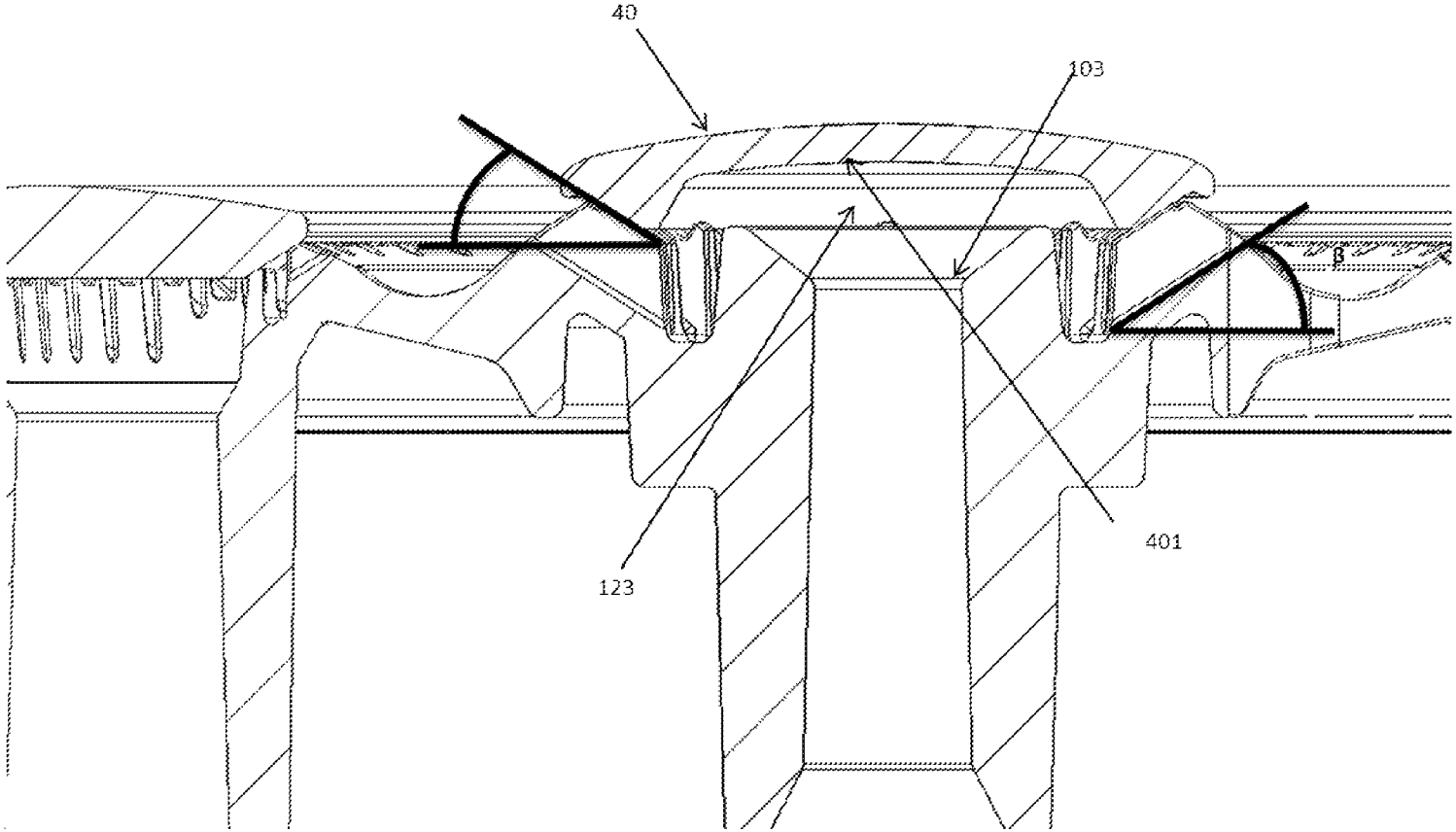
FIG. 3A is a detailed view of the first mixture chamber of the central burner with a single ring and the inclination angle of the central combustion port.

In FIGS. 3 and 3A more detail can be seen of the central burner (10) with a single ring, which comprises an upper surface (101) and a lower surface (102). At the center of said upper surface (101) an exit is found (103) for a first Venturi tube (104) and a central crenellated wall (105) which surrounds said exit (103) of the first Venturi tube (104), a first mixture chamber (123) is formed in the area above the exit (103) of the first Venturi tube (104), and the lower surface (401) of the central cover lid (40), in said first mixture chamber (123) the first combustible-air mixture (9) takes place completely which is emanating from the first combustible-air mixture (4); between said central crenellated wall (105) and the exit (103) of the first Venturi tube (104) a first distribution channel (106) is found. Said first distribution channel (106) has a cross-cut section which is uniform, in such a way that the area through which the volume of the first combustible-air flows through will be kept constant.

Continuing onwards to FIG. 3, said figure shows details of a central crenellated wall (105), which comprises three sections, a first section (108) which is substantially vertical and which extends from a back wall (107) of the first distribution channel (106), a second section (109) which is inclined outwardly and upwardly from the highest part of the first vertical section (108), and a third section (110) which is curved and extends outwardly and downwardly from the highest point of the second inclined section (109), said third curved section (110) extends up to an intermediary point between the back wall (107) of the first distribution channel (106); and the highest point of the first vertical section (108).

The exit (103) of the first Venturi tube (104) extends up to a height which is over the highest point of the first vertical section (108), but underneath the highest point of the second inclined section (109).

Said exit (103) of the first Venturi tube (104) comprises an outer section which is substantially horizontal (112) and an inner flared section (113), the inner flared section (113) serves for accelerating the combustible air mixture of the first mixture chamber (123) towards the first distribution channel (106).

Nearby the lower surface (102) of the central burner (10) with a single ring, said first Venturi tube (104) is found, whether it be as a monolithic body or in an integrated shape into said central burner (10) with a single ring, in said first Venturi tube (104) is where a first pre-mixture of the combustible (3) is carried out together with the primary air (1) which enters into the first Venturi tube (104); similarly on the lower surface (102) a peripheral bumper (114) is found which comes into contact with the cover (6) where said burner will be installed.

In so far as FIG. 3A, the inclination angle ($\alpha$) of the second section of the central crenellated wall (105) in reference to the horizontal one, can be seen, found within the range of approximately 30° to approximately 40°, preferably approximately 35°. Similarly, the inclination angle ($\beta$) in reference to the horizontal one, can be seen, which is found within the range of approximately 20° to approximately 41°, preferably approximately 33°.

Figure 4:
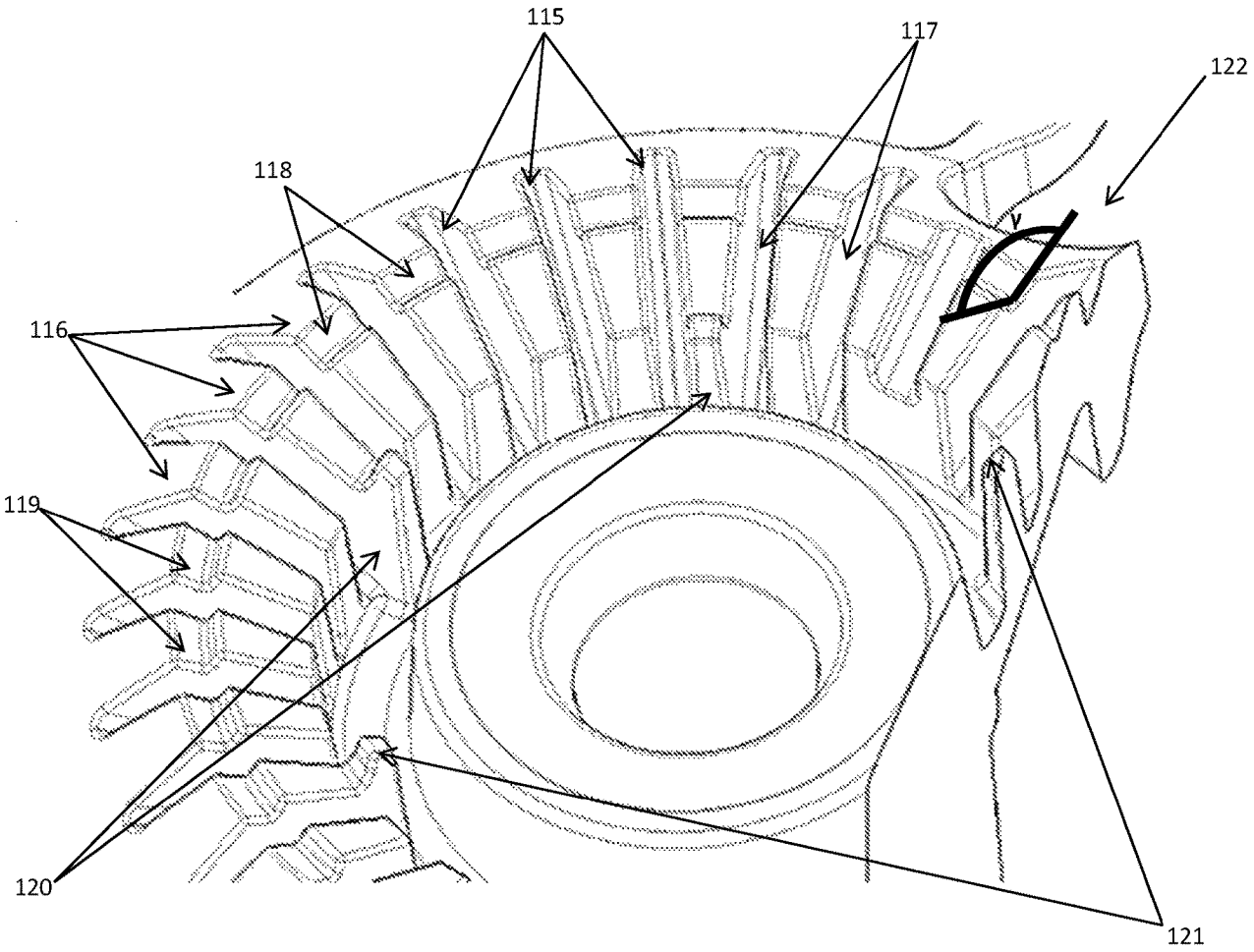
FIG. 4 is a detailed view of the combustion ports of the central burner with a single ring.

With reference to FIG. 4, which shows the central crenellated wall (105) in a detailed manner, which presents a plurality of radial grooves (115) at a same depth, in such a way that a plurality of crenels (116) are formed on the central crenellated wall (105), said radial grooves form a plurality of main central combustion ports (117); at the joining point between the second (109) and third section (110) of said central crenellated wall (105) a circumferential groove (118) is found which forms a ring of flame (119), said circumferential groove (118) presents a V shape, and the upper borders of said groove present the edges as finished off, said radial groove presents an angle (y) which is found within approximately 80° to approximately 100°, preferably approximately 90°. The grooves (115) which form said main central combustion ports (117) present a lower end and an upper end, the lower end being broader than the upper end, preferably, said lower end is rounded. The main peripheral combustion ports (117) present a perimeter recess.

Some of the crenels (116) present a back section (120) which extends itself towards the first distribution channel (106), said back section (120) presents a spur (121) which extends upwardly thereof up to a height below the highest point of the second section (109) of the crenellated wall (105).

In an embodiment, on the third section (110) of the central crenellated wall (105) an opening (122) is found where a spark plug (not shown) protrudes for the igniting of said central burner (10) with a single ring.

In an alternative embodiment which is not shown, there is no spark plug to ignite the combustible-air mixture emanating from any of the burners, so that the ignition of said mixture is carried out by means of an external flame (matches, lighter, etc).

Figure 5:
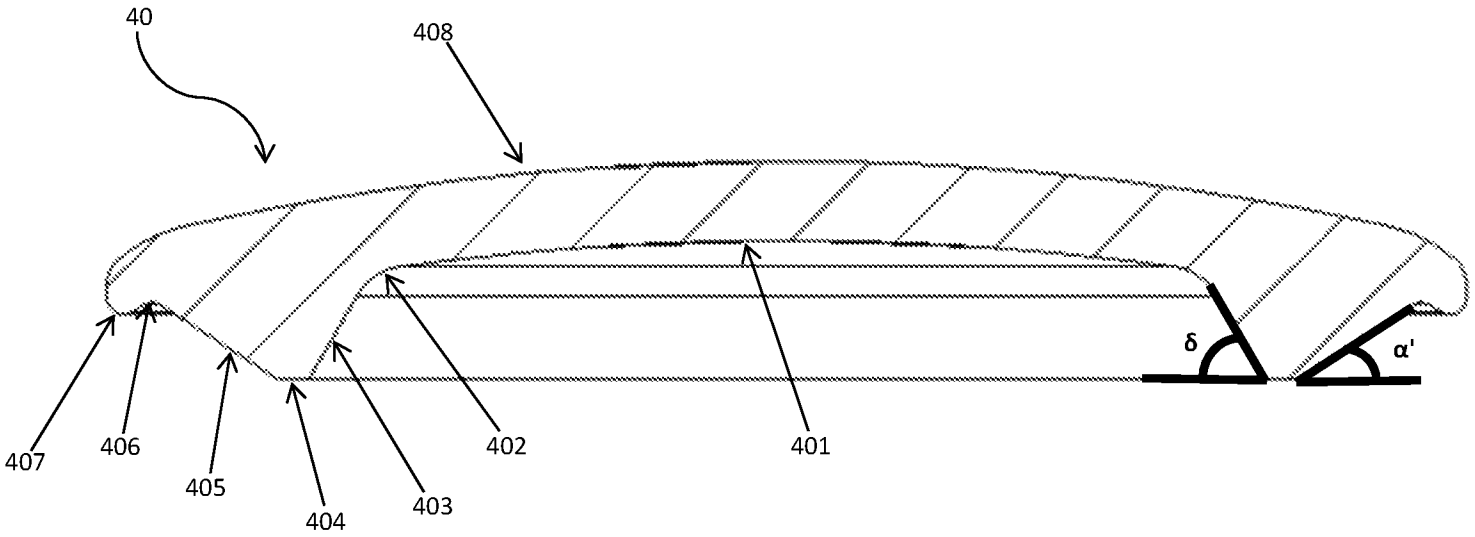
FIG. 5 is a lateral view of the central cover lid of the central burner with a single ring.

Similarly, in FIG. 5 a longitudinal cut is shown for the central cover lid (40), which is preferably steel. Said cover lid (40) is placed over the central combustion ports (117, 199) of the central ring burner (10).

The cover lid (40) presents a concave lower surface (401) which defines an upper limit for the central mixture chamber (123), said concave lower surface (401) presents a transition zone (402) which is rounded towards a first peripheral wall (403) inclined downwardly and outwardly, said inclination in relation to the horizontal one, presents an angle ($\delta$) which is between approximately 60° to approximately 80°, preferably approximately 70°, a plane border (404) which is horizontal at the end of said peripheral wall (403), said plane border (404) rests on the space formed between the spur (121) and the second section (109) of the central crenellated wall (105), a second peripheral wall (405) with an inclination angle (a') inclined outwardly and upwardly from the plane border (404) which rests over the second inclined section (109) of the central crenellated wall delimiting the upper border of the main central combustion ports (117), said inclination angle ($\alpha'$) is substantially equal to the inclination angle ($\alpha$) of the second section (109) of the central crenellated wall (105), a second transition zone (406) which is rounded between the second peripheral wall (405) and a rounded protuberance (407) which extends downwardly at the end of said second transition zone (406), and an upper convex surface (408); the purpose of said rounded protuberance (407) which extends downwardly is to anchor the dart flame to the central burner (105) with a single ring.

In an embodiment which is not shown, the central cover lid (40) presents a straight horizontal end instead of said rounded protuberance (407).

Figure 6:
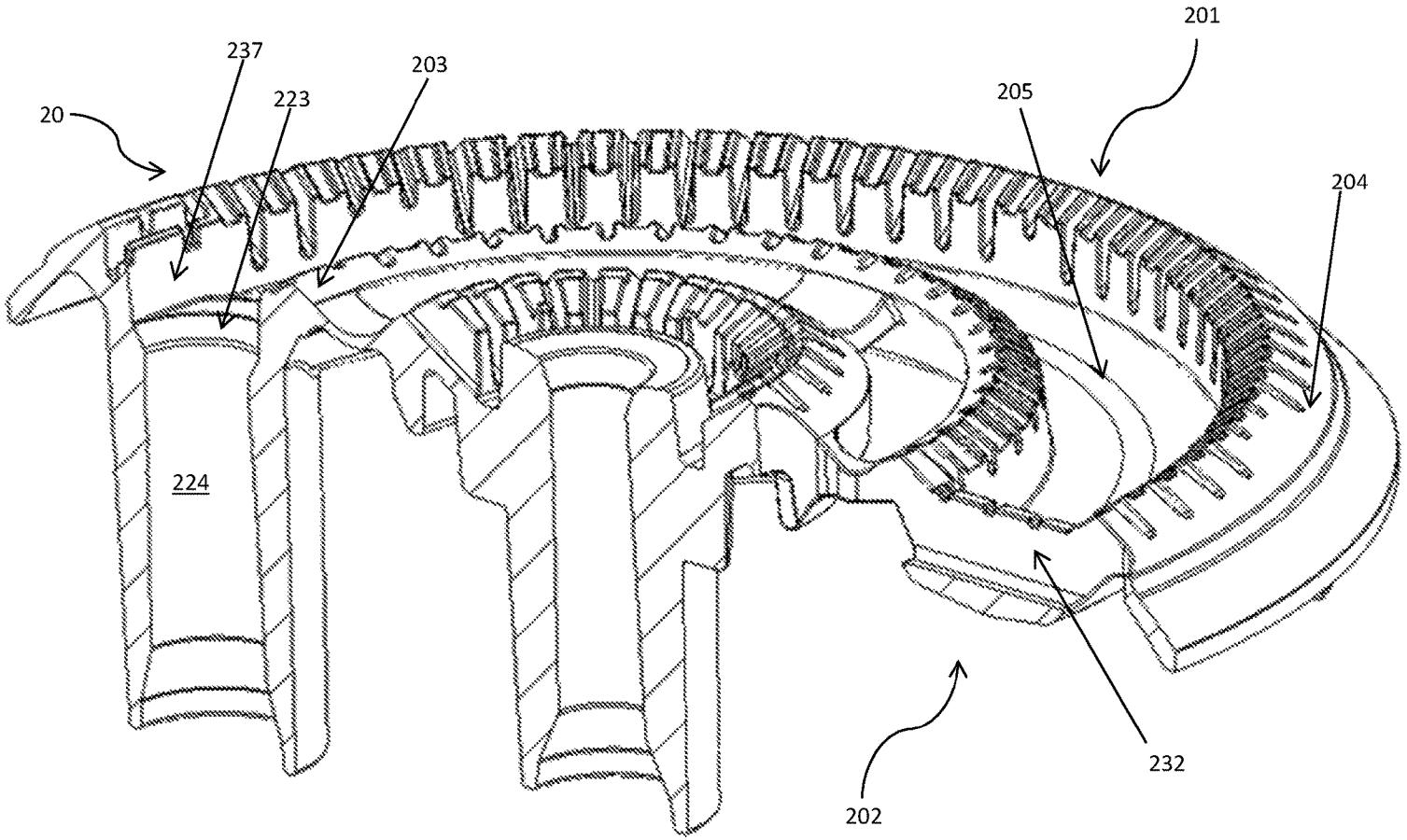
FIG. 6 is a detailed view of the toroidal burner with double rings.
Figure 7:
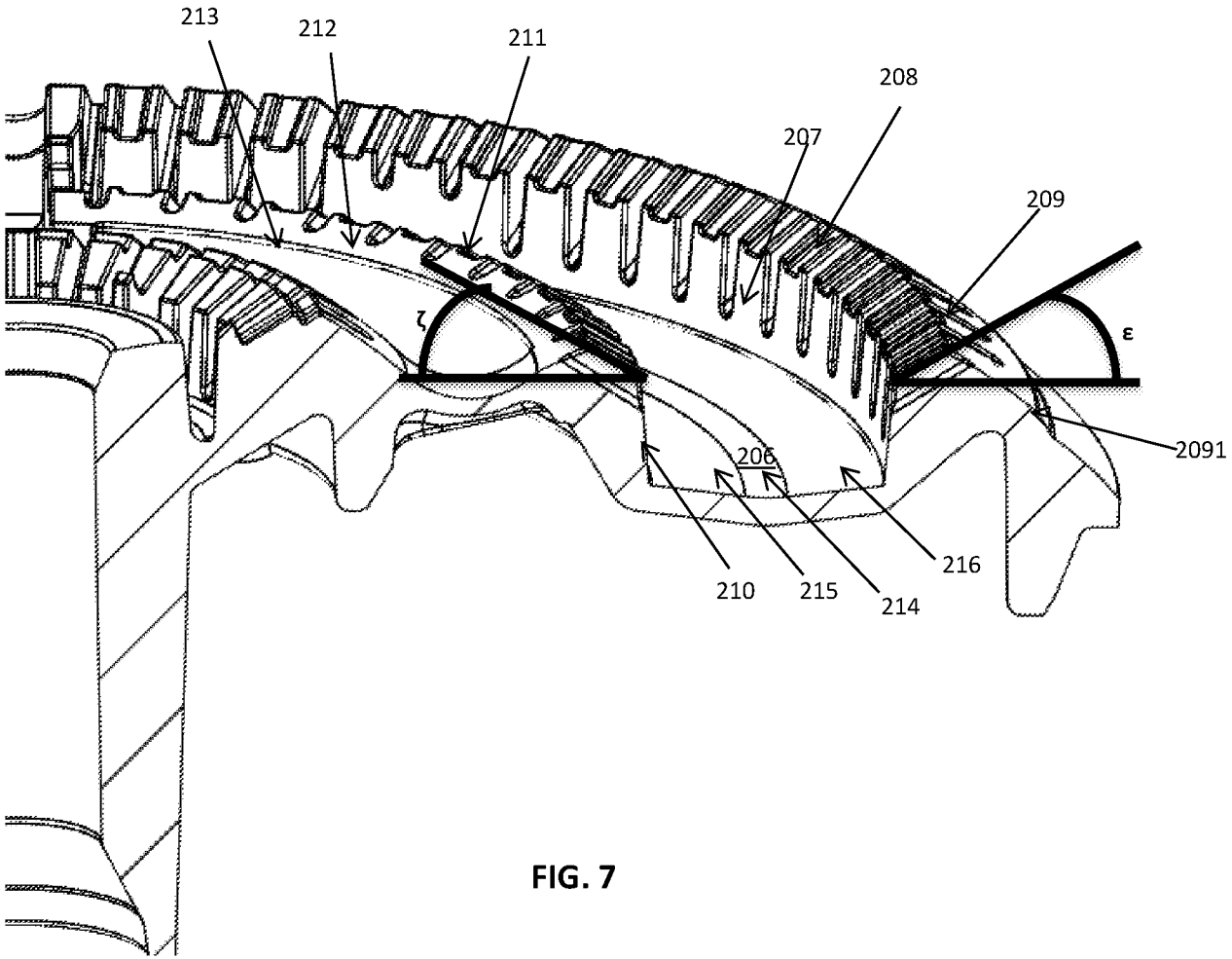
FIG. 7 is a detailed view of the toroidal burner with doable rings.

In FIGS. 6 and 7 a longitudinal cut can be seen of the double ring toroidal burner (20), which comprises an upper surface (201) and a lower surface (202)' on said upper surface (201) an inner crenellated wall (203) is found as well as an outer crenellated wall (204), which are preferably concentric, separated between them by a second distribution channel (205); a second mixture chamber (237) set above the exit (223) of the Venturi tube (224) between the inner (203) and outer (204) crenellated walls and delimited by the lower surface of the toroidal cover lid (50), the purpose of said second mixture chamber (237) is the same as that of the first mixture chamber (123), it undertakes the final mixture of combustible air of the combustible-air mixture emanating from the second Venturi tube (224); the outer crenellated wall (204) comprises three sections, a first section (207) substantially vertical which extends from a back wall (206) of the second distribution channel (205), a second section (208) inclined outwardly and upwardly from the highest part of the first substantially vertical section (207), the inclination angle ($\varepsilon$) of said second section is found within a range of approximately 22° and 42°, preferably approximately 32°, and a third curved section which extends outwardly and downwardly from the highest point of the second inclined section, said third curved section (209) which extends outwardly and downwardly from the highest point of the second inclined section (208), said third curved section (209) extends up to a point underneath the inner surface of the back wall (206) of the second distribution channel (205), said third curved section (209) presents at least one circumferential groove (2091) which serves for increasing the feeding of secondary air to the flame: the inner crenellated wall (203) comprises four sections, a first section (210) which is substantially vertical and which extends from the back wall (206) of the second distribution channel (205), a second section (211) inclined outwardly and upwardly from the highest point of the first section (210) which is substantially vertical, the inclination angle (ζ) of said second section is found within a range of approximately 22° and 42°, preferably approximately 32°, a third curved section (212) which extends outwardly and upwardly from the highest point of the second section (211) inclined up to a point which is above the highest point of the first section (210) and a fourth vertical section (213) which extends downwardly from the lowest point of the third section (212) which is curved and up to a point above the highest point of the first section (210).

The back wall (206) of the second distribution channel (205) comprises three sections, a first central section (214) and two outer sections (215, 216); the outer sections (215, 216) are inclined towards the central section (214) of said back wall. (206), the end sections of the outer sections (215, 216) of said back wall (206) are higher than the central section (214) of said back wall (206); it should be noted that the second distribution channel (205) has a transversal section which is uniform, in such a way that the area through which the flow of the combustible-air mixture (10) passes through is kept constant.

Figure 8:
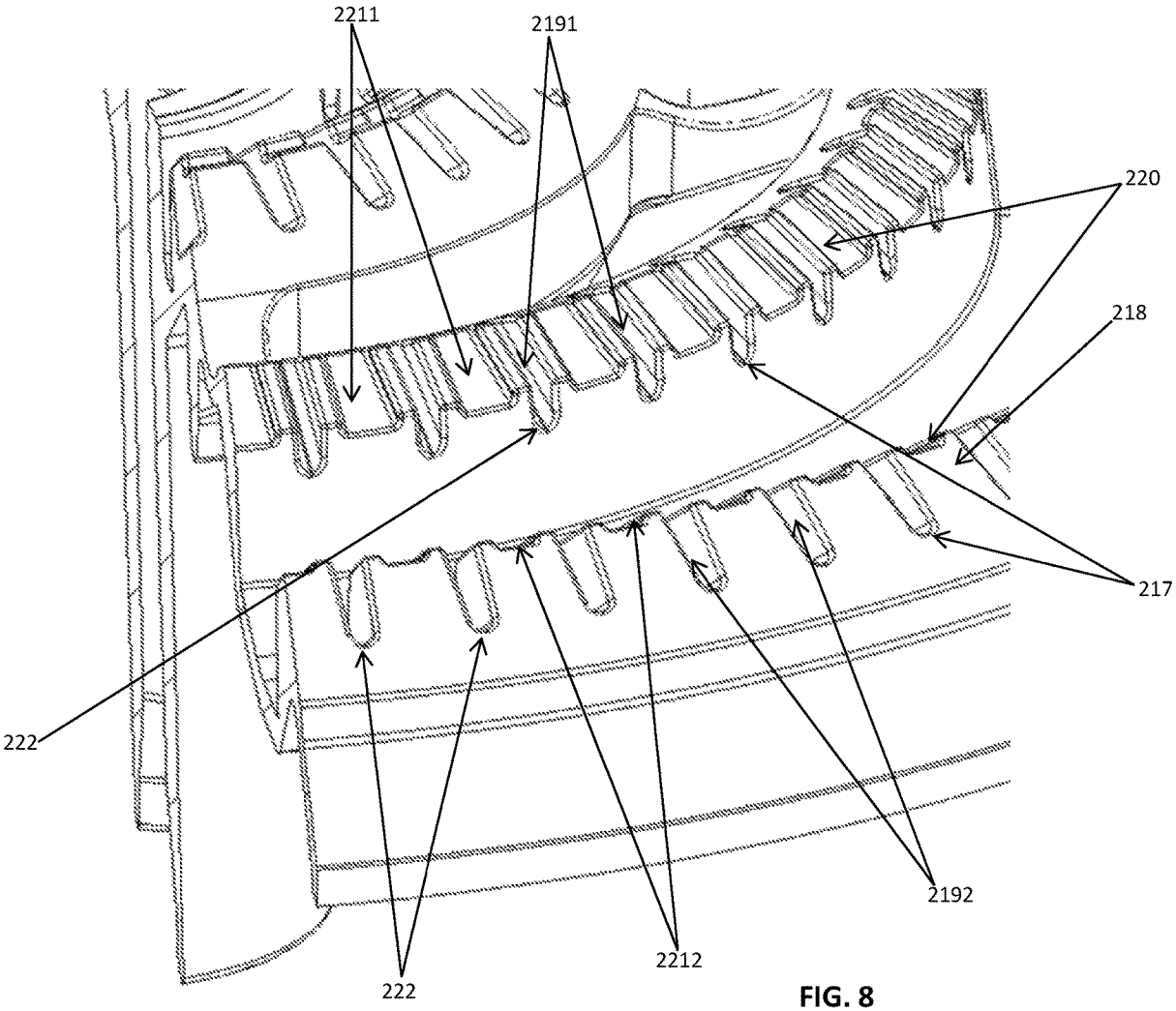
FIG. 8 is a detailed view of the combustion ports of the toroidal burner with double rings.

FIG. 8 shows a detailed view of the inner crenellated walls (203) and outer crenellated walls (204), which present a first plurality of first radial grooves (217) at a first depth, in such a way that the crenels (218) are formed in said crenellated walls (203, 204), in such a manner that said first radial grooves (217) form a plurality of main peripheral combustion ports, said combustion ports are divided into main primary inner peripheral combustion ports (2191), main secondary inner peripheral combustion ports (2192) and main outer peripheral combustion ports (2192), depending on the arrangement thereof, whether it be on the inner crenellated wall (203) or on the outer crenellated wall (204), said first and second grooves present a lower end and an upper end, the lower end being broader than the upper end, similarly, said lower end is rounded, the main peripheral combustion ports present a perimeter recess; the plurality of crenels (218) presents a second radial groove (220) at a second depth, the second depth being between 1/10 and 1/8 of the first depth, said second radial grooves (220) being wider than the first radial grooves on their upper end, the width of the first radial groove being between 1/4 and 1/5 of the width of the second groove, said plurality of second radial grooves form a plurality of secondary peripheral combustion ports, which are divided into inner secondary peripheral combustion ports (2211) and outer secondary peripheral combustion ports (2212), depending on the arrangement thereof, whether it is on the inner crenellated wall (203) or on the outer crenellated wall (204).

Figure 8A:
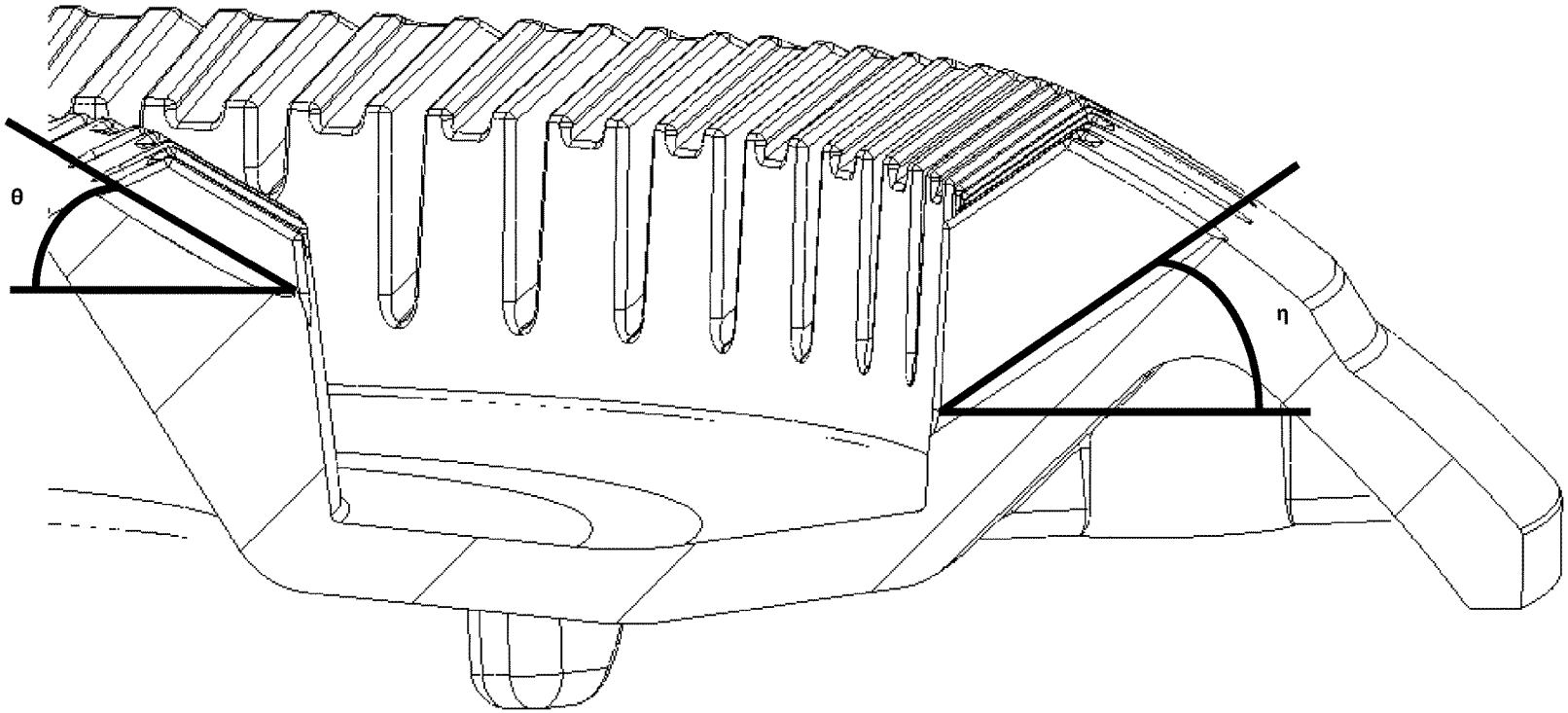
In FIGS. 8A and 8B one can see a detailed view of the inclination angle of the main inner and outer peripheral combustion ports and of the secondary inner and outer peripheral combustion ports.

In FIG. 8A the inclination angle (η) in relation to a horizontal plane of the main outer peripheral combustion ports (2192) can be seen which are found within a range between approximately 29° to 45°; preferably between approximately 32° to approximately 42°, preferably approximately 37°. Similarly, the inclination angle (θ) can be seen in regards to a horizontal plane of the main inner peripheral combustion ports (2191) which is found within a range between approximately 23° to approximately 39°; preferably between approximately 26° to approximately 36°, preferably approximately 31°.

Figure 8B:
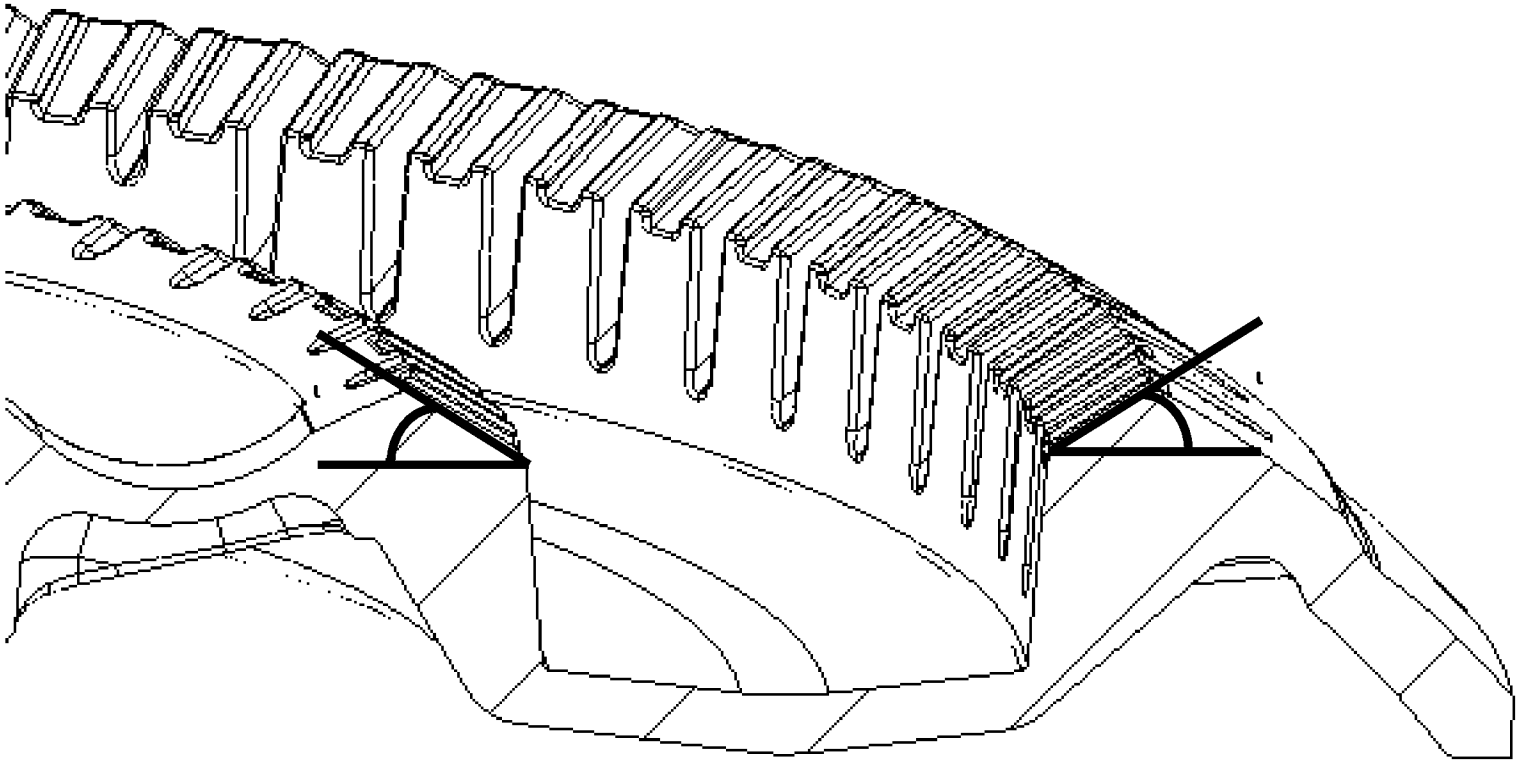

In FIG. 8B the inclination angle (t) can be seen in regards to a horizontal plane of the secondary outer peripheral combustion ports (2212) as well as the inner ones (2211), which are found within a range between approximately 23° to 38°; preferably between approximately 25° to approximately 35°, preferably approximately 30°.

In an alternative embodiment not shown, on the third section (209) of the outer crenellated wall (204) an opening is found where a spark plug (not shown) protrudes for the igniting of said peripheral double ring burner (20). Similarly, in the third (212) and fourth (213) sections of the inner crenellated wall (203) an opening is found (not shown) from which a spark plug (not shown) protrudes for the igniting of said peripheral double ring burner (20).

Figure 9:
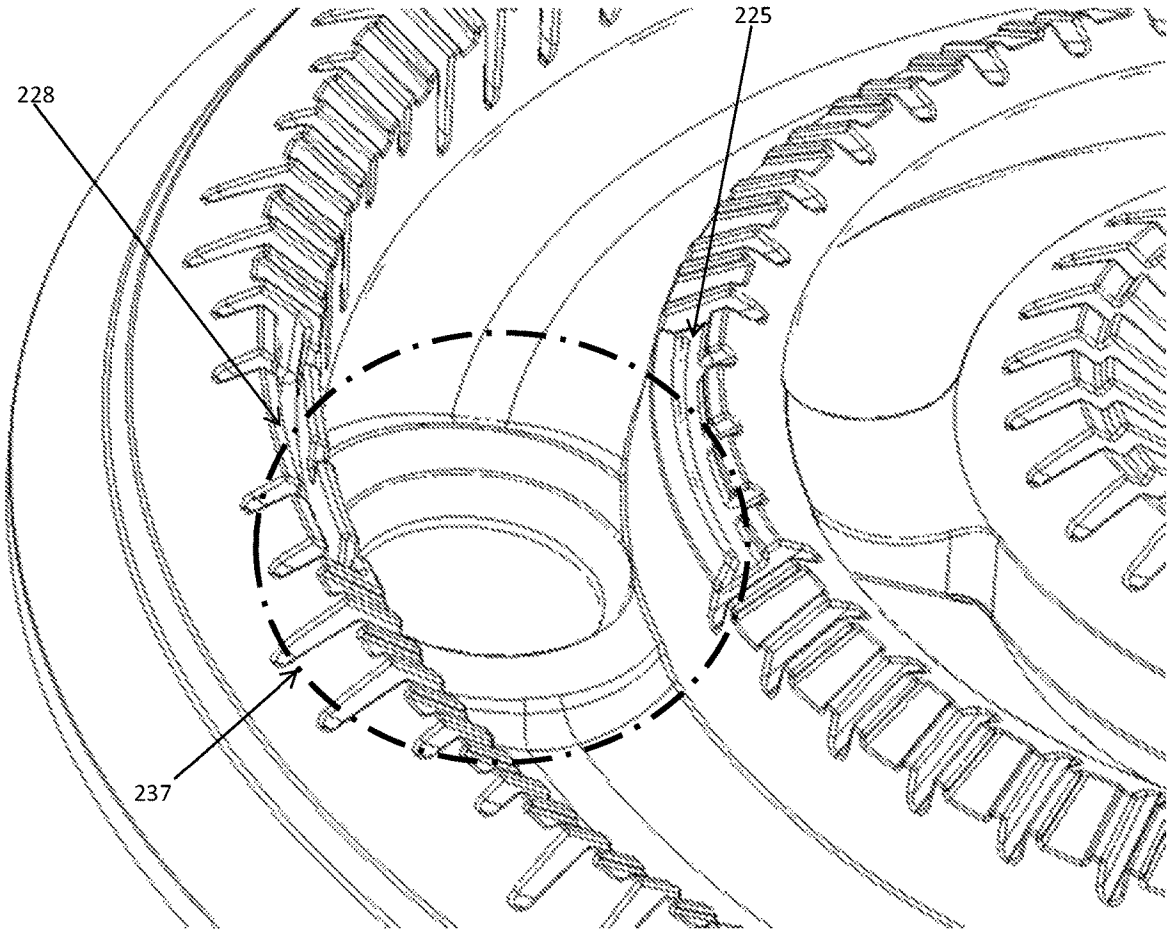
FIG. 9 is a detailed view f the mixture chamber of the double ring toroidal burner.

FIG. 9 shows a detailed view of the second mixture chamber (237) illustrated by way of lines and dots, where an exit (223) of the second Venturi tube (224) is found, which is found set above the back wall (206) of the second distribution channel (205); on the lower surface (202) of the double ring toroidal burner (20), said second Venturi tube (224) is found, in an alternative embodiment said second Venturi tube (224) is found integrated within said double ring toroidal burner (20), in an alternative embodiment said second Venturi tube (224) and the double ring toroidal burner (20), are found in a single monolithic body.

Adjoining the exit (223) of the second Venturi tube (224) an inner harrier rail (225) is found on the inner wall (203) and an outer barrier rail (228) on the outer wall (204), said inner and outer barrier rails (225, 228) present a sinuous trajectory which follows the second combustible-air mixture (10) prior to becoming fully incorporated into the second distribution channel (205), so upon presenting a turbulent flow to the inner part of said barrier rails, the energy of the combustible-air (10) is dissipated and thus the particles which enter the combustion ports are able to have a lower velocity, thereby allowing adequate ignition of said final combustible-air mixture.

Figure 9A:
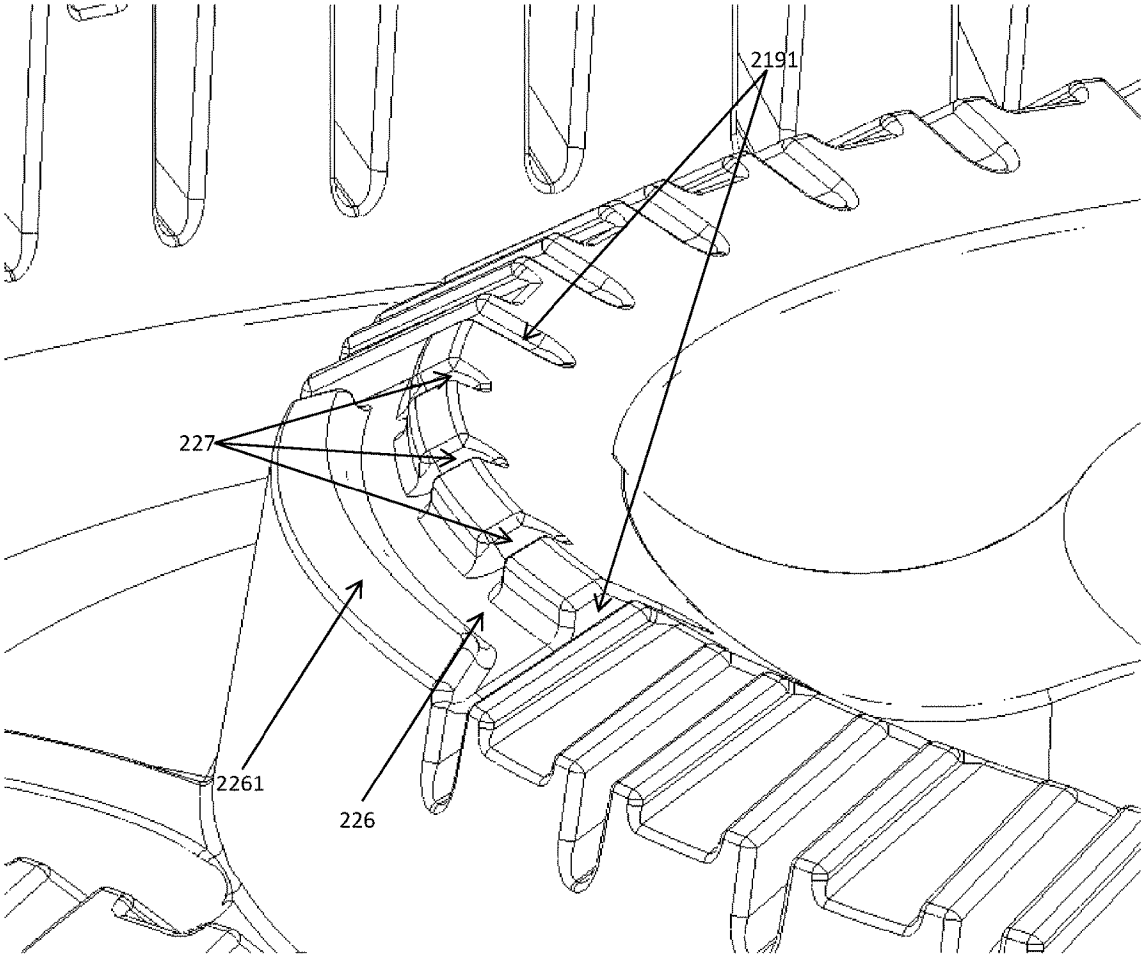
FIGS. 9A and 9B are detailed views of the barrier rails of the double ring toroidal burner.

FIG. 9A shows said inner barrier rail (225) in detail, which comprises a first circumferential groove (226) concentric to the second distribution channel (205) in the second section (208) of said inner crenellated wall (203) which is found in fluid communication solely with a pair of main inner peripheral combustion ports (2191) on the sides of said first groove (226), similarly, said first groove (226) presents a wall (2261) which avoids the direct ingress of the combustible-air mixture (10) into said inner barrier rail (225), said first circumferential groove (226), presents a plurality of radial grooves which come out of said inner segment (203), forming a plurality of inner barrier rail combustion ports (227) through which a part of the combustible-air mixture (10) is ignited once it has lost energy in said inner barrier rail, the depth of the first circumferential groove (226) is approximately 1/4 and 1/5 the depth of the main inner peripheral combustion ports.

Figure 9B:
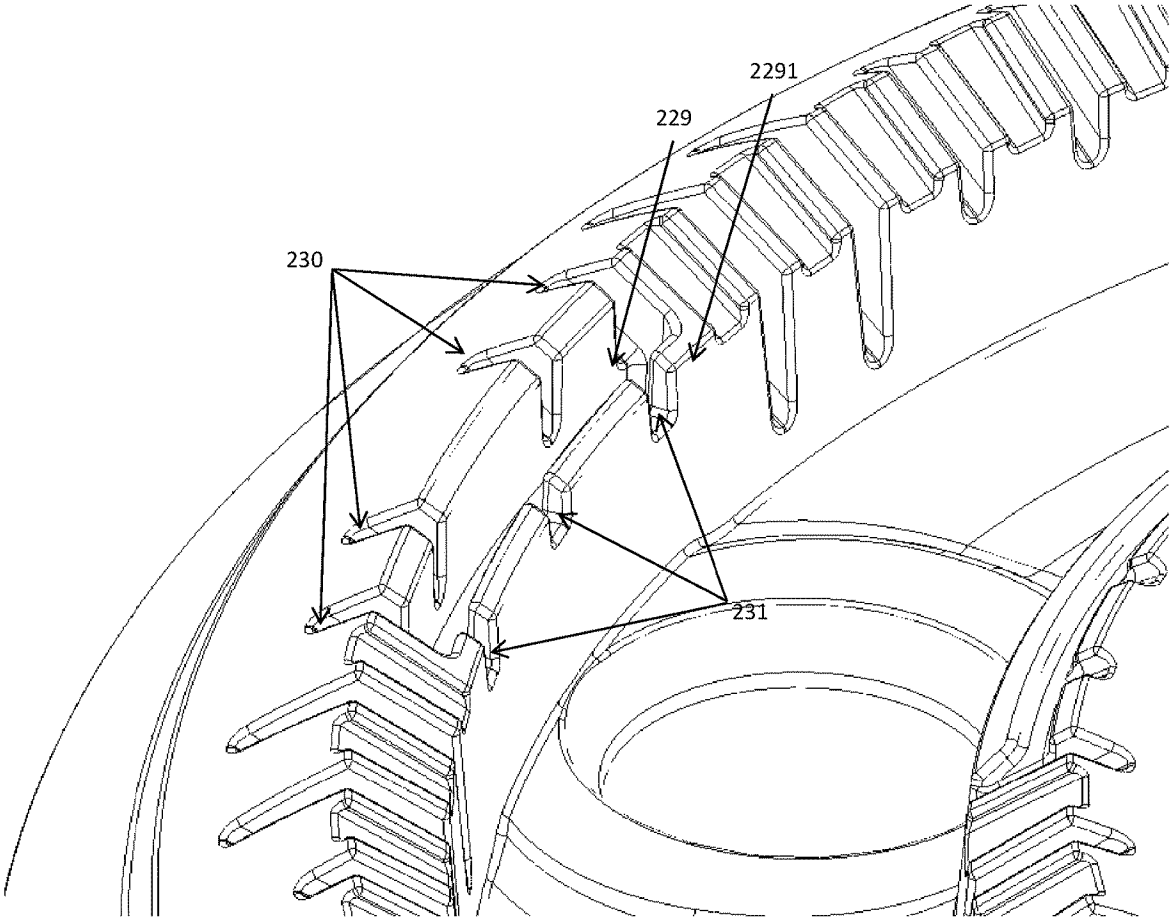

In FIG. 9B details can be seen of said outer barrier rail (228), which comprises a second circumferential groove (229) concentric to the distribution channel (205) thereby forming a wall (2291) which separates a second circumferential groove (229) from the distribution channel (205); along the length of said second circumferential groove (229) a radial groove is found at each end of said circumferential groove, as well as at least one radial groove between said end radial grooves, which come out of the outer crenellated wall (204), forming a plurality of combustion ports for an outer barrier rail (230); a plurality of communication grooves (231) which communicate a second circumferential groove (229) with the distribution channel (205), the plurality of combustion ports for an outer barrier rail (230) are found unaligned with the communication grooves (231); the depth of the second circumferential groove (229) is approximately between ½ and ⅔ the depth of the distribution channel (205).

Figure 10:
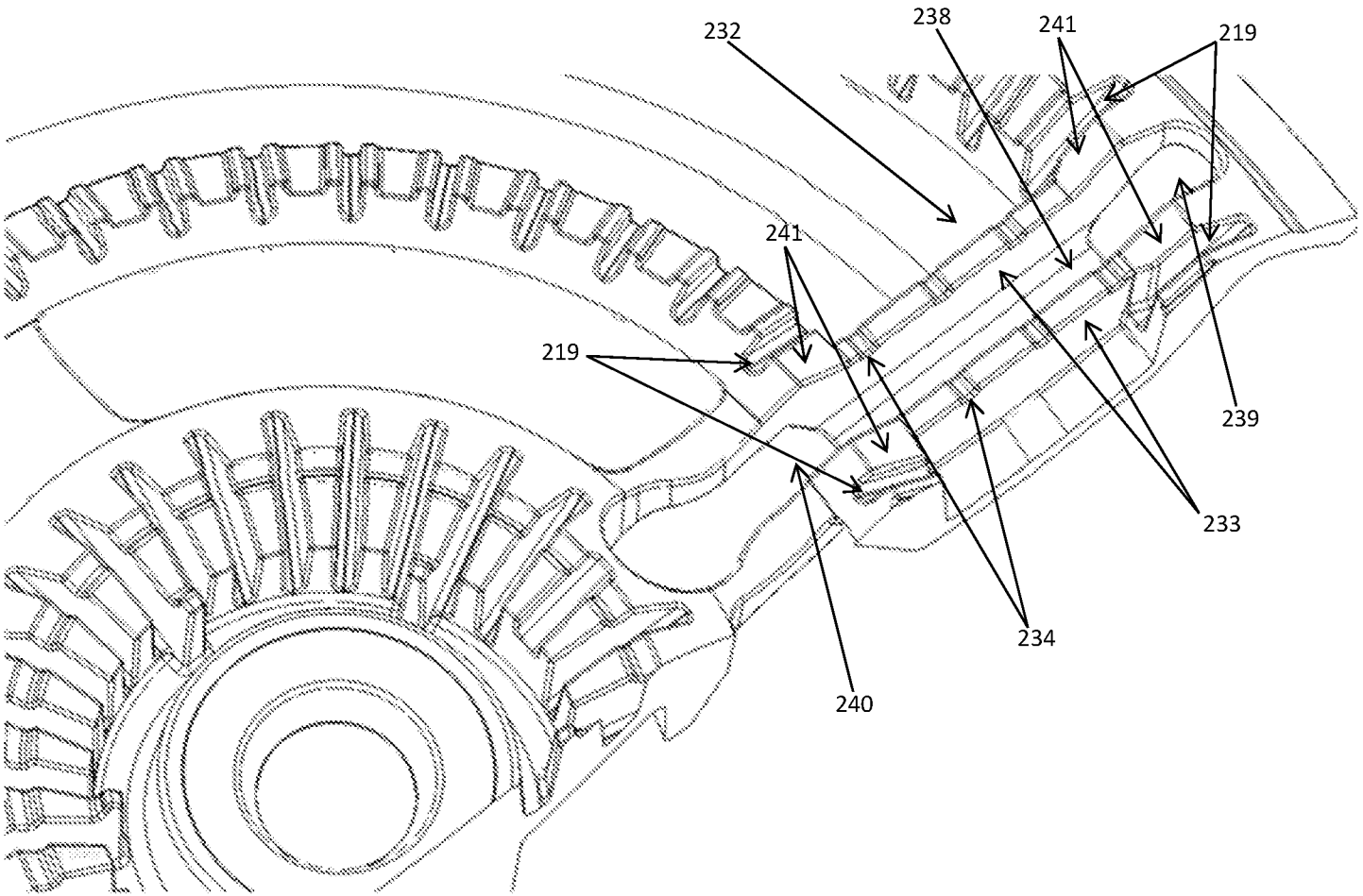
FIG. 10 is a detailed view of the transfer and stability chamber of the double ring toroidal burner.
Figure 10A:
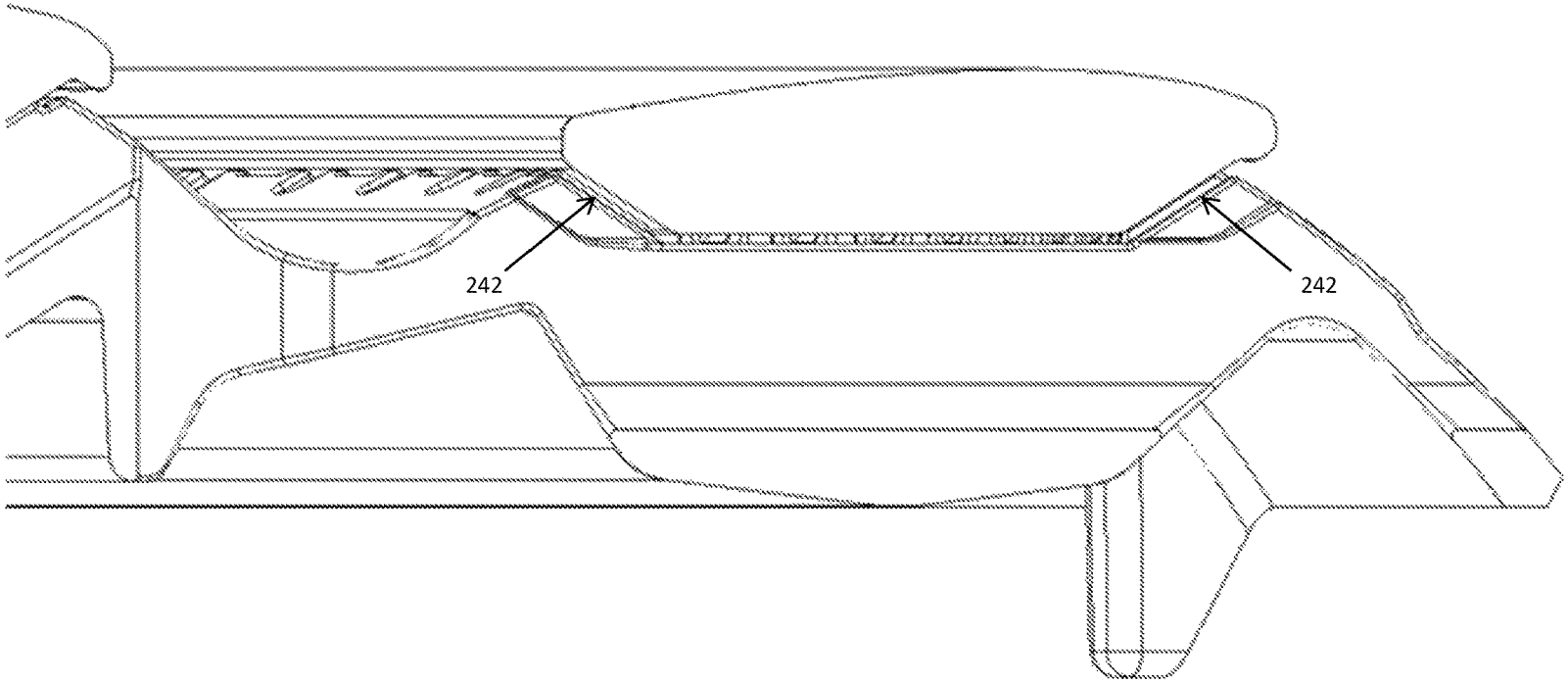
FIG. 10A is a detailed view of the space formed between the ends of the transfer and stability chamber and the toroidal cover lid.

FIG. 10 shows a detailed view of a stability and transfer of flame chamber (232), which is found diametrically opposed to the exit (223) of the second Venturi tube (224), said stability and transfer of flame chamber (232), transfers the flame from the inner crenellated wall (203) towards the outer crenellated wall (204) or vice versa, depending on where the ignition spark plug (not shown) is located; said stability and transfer of flame chamber (232) must be found set between two main inner and outer peripheral combustion ports (219), in such a way that said main peripheral combustion ports (219) ignite the combustible-air mixture (10) which is found in said chamber (232); said stability and transfer of flame chamber (232) comprises a back wall (238) and a pair of radial walls (233) which are parallel to each other and which are perpendicular to said back wall (238), set between the inner (203) and outer (204) crenellated walls, substantially perpendicular to the back wall of the second distribution channel (205); the upper wall is found in connection with a pair of peripheral crenels for stability and transfer (241) on the side, being inner and outer, said radial walls (233) present a plurality of transversal grooves, in such a way that they form combustion ports for flame transfer (234), said combustion ports for flame transfer (234) present a back wall and two lateral walls which are substantially perpendicular to said back wall, similarly, said combustion ports for flame transfer (234) are found inserted into said radial walls; on the ends of said stability and transfer chamber (232) two secondary air feeding windows are found (239, 240); the radial walls present two ends (241) an inner and an outer.

in FIG. 10A it can be seen in a detailed manner that the peripheral crenels for stability and transfer (241) present a height which is substantially lower than the height of the crenels (218) which form the inner and outer main peripheral combustion ports (219) in such a way that a free space is formed (242) between the toroidal cover lid (50) and said peripheral crenels for stability and transfer (241), through which the flame is transferred towards the inner part of the stability and transfer chamber (232).

Similarly, said double ring toroidal burner (20) presents a toroidal cover lid (50), preferably made of steel. Said toroidal cover lid (50) is placed over the peripheral combustion ports of the double ring toroidal burner (20).

Figure 11:
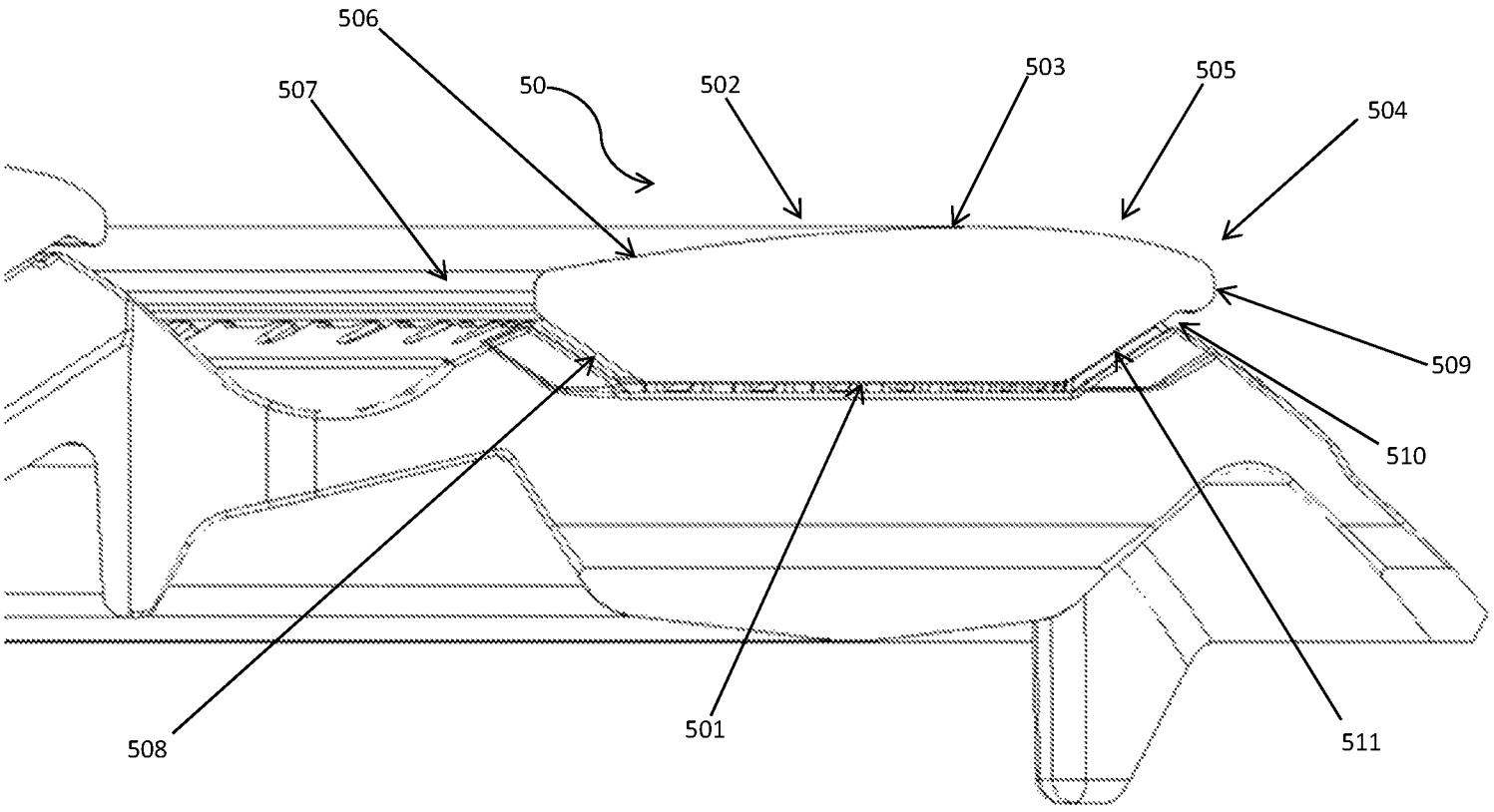
FIG. 11 shows a cross cut view of the toroidal cover lid.

In FIG. 11 it can be seen that said steel toroidal cover lid (50) presents a horizontal lower plane surface (501) which defines an upper limit for the second distribution channel (205) and a curved upper surface (502), which presents an upper point (503) in close proximity to the outer end (504) of said cover lid, a first curvature (505) which extends from the upper point (503) towards the outer end (504) of the cover lid (50) and a second curvature (506) which extends from the upper point (503) towards the inner end (507) of the cover lid (50), the radius of the second curvature (506) being greater than that of the first curvature (505). The outer end (504) of the cover lid (50) extends above from the inner end (507) of the cover lid; similarly the lower plane surface (501) joins with the inner end (507) of the cover lid (50) by means of a first rounded bevel (508) which presents an inclination angle (ζ') which substantially coincides with the (ζ) inclination angle of the second section of the inner crenellated wall, the outer end (504) of the cover lid (50) presents a protuberance (509) with a substantially horizontal plane lower end (510), which itself joins with the lower plane surface (501) by means of a bevel (511), said second bevel (511) presents an inclination angle (ε') which substantially coincides with the inclination angle (ε) of the second section of inner crenellated wall. The main function of said protuberance (509) with the substantially horizontal plane lower end (510) is that of anchoring the flame dart to the burner.

Figure 12:
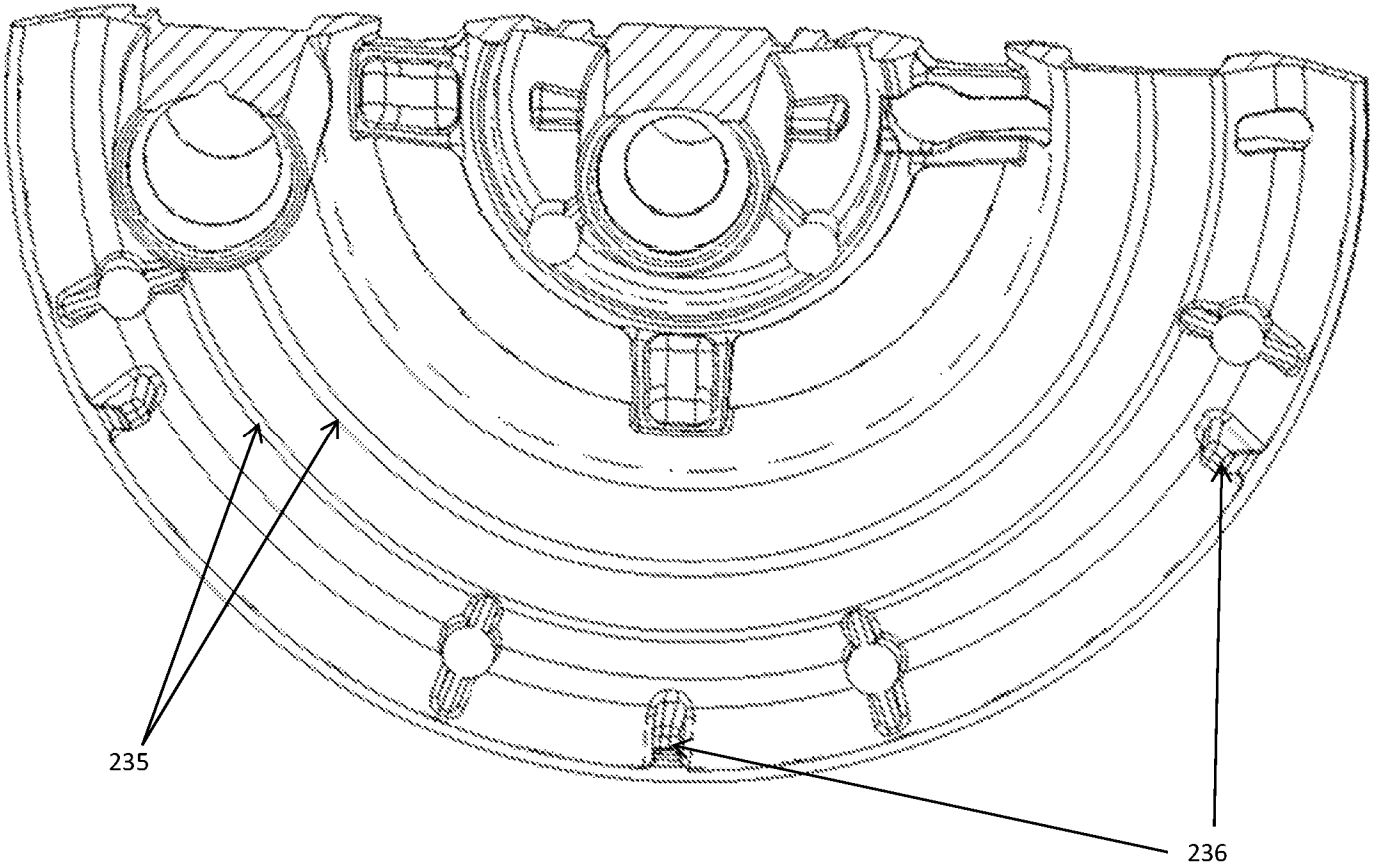
FIG. 12 shows a lower view of the triple ring burner.

FIG. 12 shows that on the lower surface (202) of the double ring toroidal burner (20) a plurality of concentric circumferential ribs (235) are found which serve as a reinforcement for the double ring toroidal burner (20), similarly, it presents a plurality of protrusions (236) which are found in close proximity to the outer perimeter of said double ring toroidal burner (20), said protrusions (236) produce a separation between the plane of the cover (6) of the burners which is the surface of the heating apparatus and the lower surface (202) of the burner (20), said separation allows the flow of secondary air (2) towards the combustion ports (2191, 2211) of the inner crenellated wall (203) of said double ring toroidal burner (20), as well as the main central combustion ports (117) of the central burner (10); the edge which the base of the burner forms with the inner crenellated wall (203), just underneath the combustion ports (219), has been provided a bevel or a radius, which allows for better air flow between the lower surface (202) of the toroidal burner (20) and the plane burner cover lid, taking more secondary air towards the combustion ports of the inner crenelated wall (203). Said protrusions (236) may present any type of shape. The lower surface (202) of said double ring toroidal burner (20), additionally functions, as a cooling surface, given that upon the secondary air (2) circulating between said lower surface (202) and the cover (6) prior to arriving at the combustion ports, it cools the burner of present invention, due to its irregular shape (see FIG. 1), the lower surface (202) offers a much greater contact area than if it was plane, in order to undertake the correct cooling.

Said multiple flame burner (1) is placed over a support (not shown) which joins with a surface of the stove, for example, by means of perforations and screws, on this support, both the first Venturi tube (104) as well as the second Venturi tube (224) are housed, on the lower part of the support, a distributor for combustible is housed, with two exits for combustible unto which the corresponding combustible nozzle is connected; the distributor of combustible is designed in such a way that it may be connected to a simple exit valve (not shown), thereby controlling the heating intensity.

Figure 13:
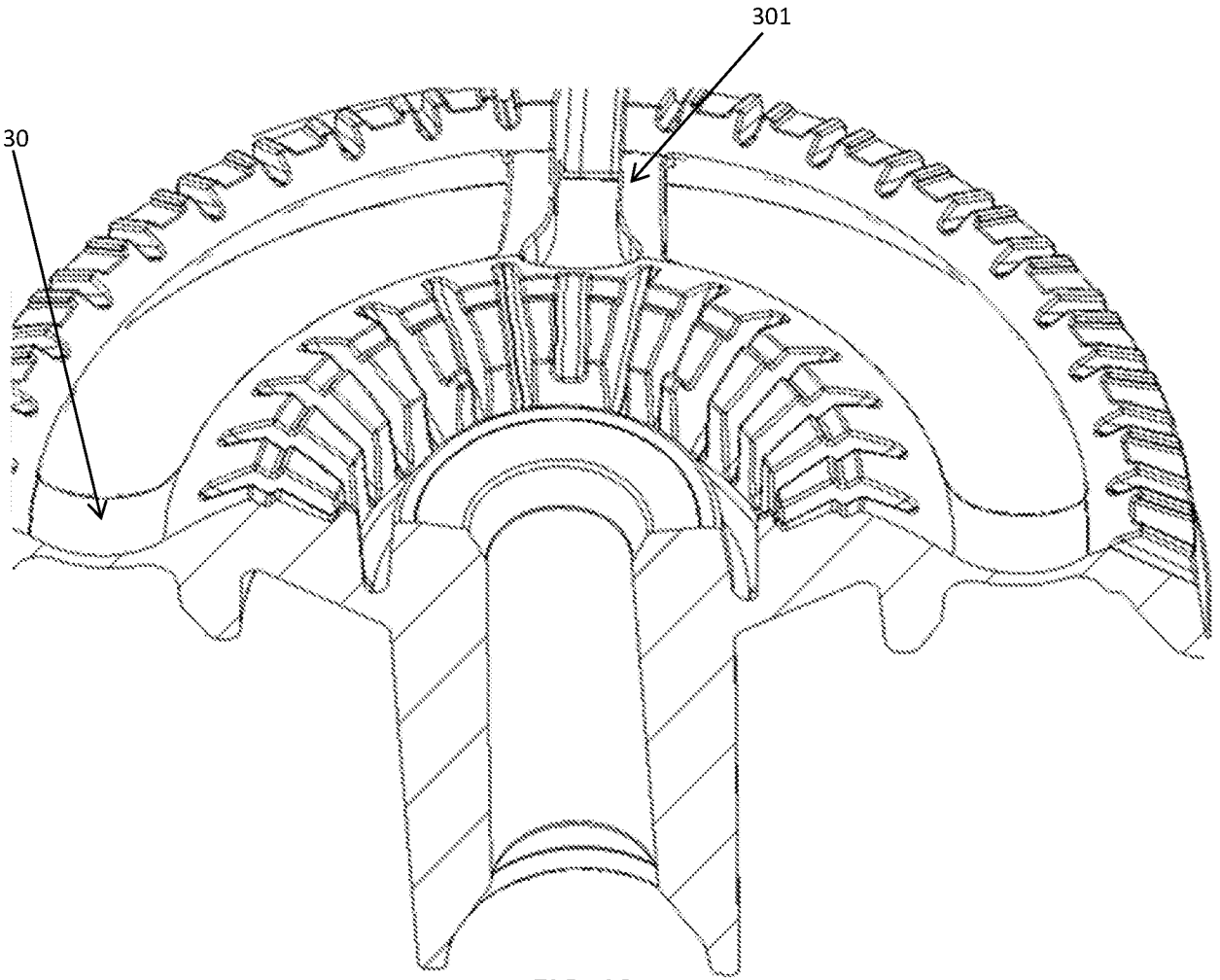
FIGS. 13 and 13*a* show a detailed view of the bridges which connect the central burner with a single ring to the double ring toroidal burner.

In FIG. 13 it can be seen that the central burner (10) is joined with the double ring toroidal burner (20) by means of at least one bridge (30), in the embodiment shown in the figures four bridges are shown, however present burner may function with at least one bridge, for illustrative purposes the embodiment which is shown shall be described, however, modifications may be undertaken in such a way that it could be that only a single bridge may be joining said central burner (10) to said double ring toroidal burner (20); in the illustrated embodiment one first bridge (301) can be seen, which is found aligned with an opening (122) where the sparkplug (not shown) protrudes from the central ring burner (10) and the flame-carrier (232) of the peripheral double ring burner (20), in such a way that said opening (122) extends partially in said first bridge (301), the space between the bridges is called a window and through said window it is possible that the secondary air feeds the flame darts which are formed in the main central combustion port and the inner peripheral combustion port.

Figure 13A:
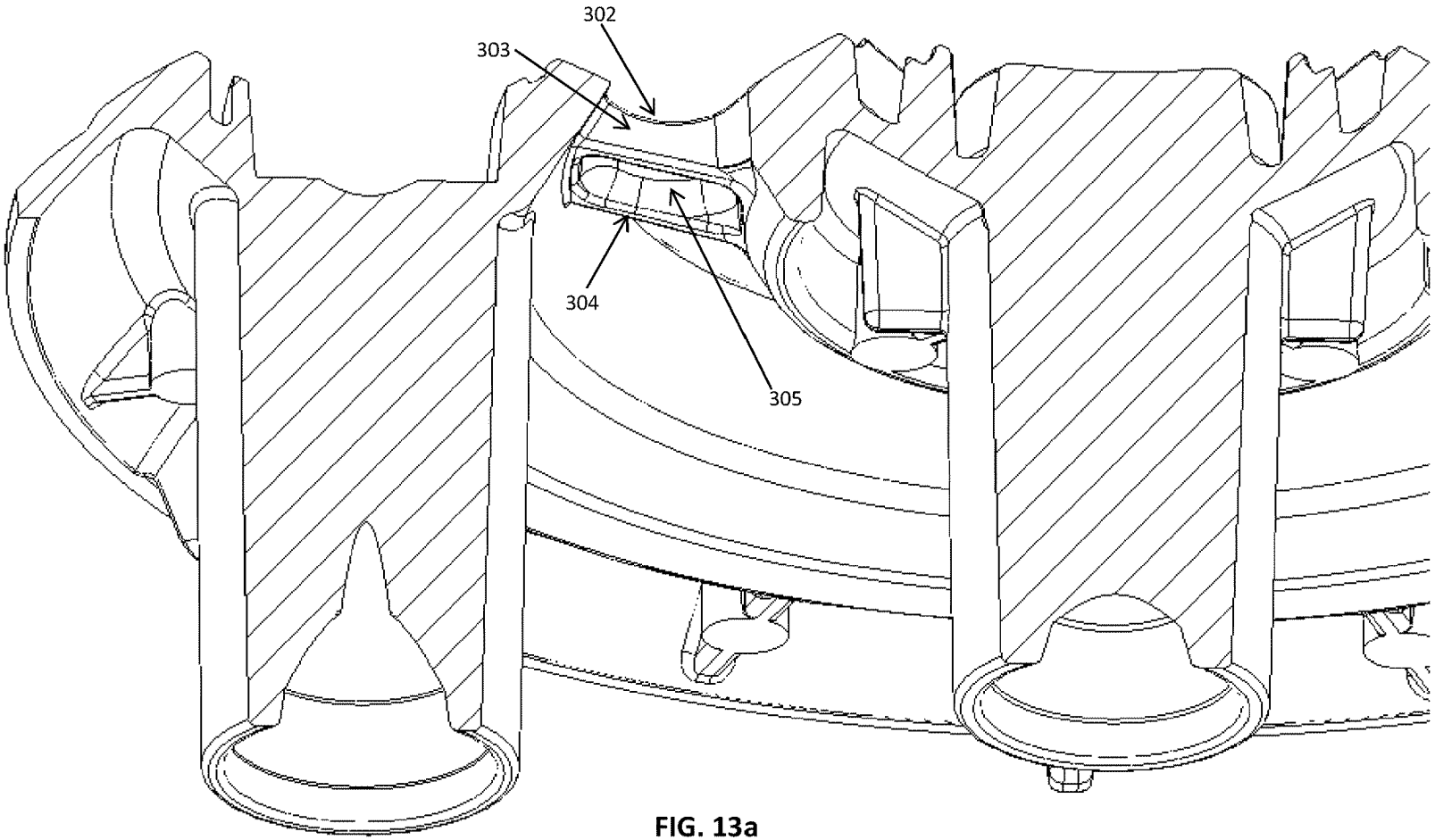

FIG. 13A shows a detailed view of said at least one bridge (30), said at least one bridge (30) is hollow, in such a way that it presents one upper wall (302), one lateral left wall (303), one lateral right wall (304) and a cavity (305) between said walls, in such a way that no lower wall exists; said upper wall (302) presents a curvature radius which defines a concavity, in such a way that it creates an arc thereof, in such a way that the thickness of said at least one bridge (30) is decreased, preferably between approximately 2 mm and 4 mm.

Decreasing the thickness of the at least one bridge (30) is due to that once the three rings of the triple ring burner (100) are found functioning, the heat which is concentrated in the central burner (10) and the inner crenellated wall (203) of the double ring toroidal burner (20), said heat causes that said at least one bridge be deformed by torsion, and once the heat is dissipated, said at least one bridge (30) upon cooling down is capable of returning to its original shape; if said at least one bridge (30) had a greater thickness, it would not be possible for it to return to its original shape, which would cause that the flame dart of the central burner (10) come out as deviated towards a side, thereby creating a lower energy efficiency than what would otherwise be expected.

Similarly, the exit of the main peripheral inner combustion ports (2191) is found on a horizontal plane underneath the horizontal plane which is found at the exit of the main central combustion ports (117), given that if the plane at which both combustion ports are found were to be identical, given the velocity at which the combustible air mixture exits from said combustion ports, a turbulence would be created which would not allow that the combustible-air mixture emanating form said main inner combustion ports and the main central combustion ports would be able to ignite.

Figure 14:
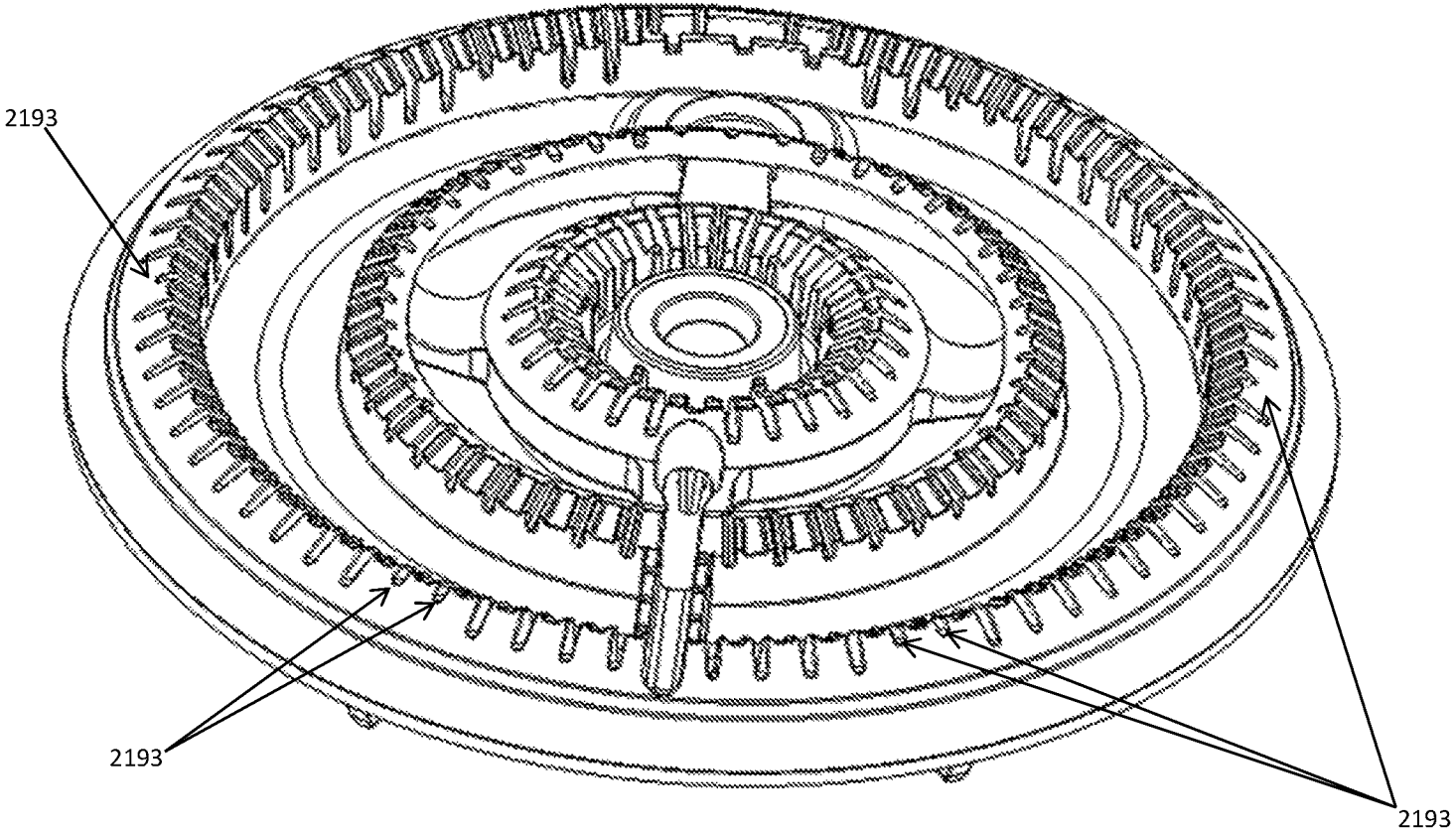
FIG. 14 shows a detailed view of the tertiary combustion ports of the double ring toroidal burner.

In FIG. 14 it can be seen how an embodiment of the present invention, some of the main peripheral outer combustion ports (2191) present a different depth to form some tertiary outer peripheral combustion ports (2193), said depth being between ⅓ and ¼ of the first depth, said tertiary outer peripheral combustion ports (2193) are designed to be underneath the stove grate (not shown), so that the amount of heat emitted by the flame dart produced by said tertiary outer peripheral combustion ports (2193) will be much lesser than that produced by main peripheral combustion ports, the layout of said tertiary outer peripheral combustion ports (2193) will vary depending on the type of grate used for each stove. The shape of said tertiary outer peripheral combustion ports (2193) is the same as that of the main outer peripheral combustion ports (2191).

The area of the main central combustion ports is different from that of the combustion port area of the outer peripheral combustion ports and of the combustion port area of the inner peripheral combustion ports, so that the volume of the combustible-air mixture is different, so that the heating velocity of the burners is different.

The functioning of the multiple flame burner of present invention is the following:

If one wishes to work with only one central flame ring a multiple selection valve (not shown) is activated which allows the flow of combustible (3) towards the first Venturi tube (104), given the difference in velocities of said combustible (3), primary air (1) from the surroundings is dragged towards the inner part of said first Venturi tube (104), forming a first combustible-air pre-mixture (4), which presents a turbulent flow which exits at a first velocity, which itself is not sufficiently uniform to carry out an adequate dart flame ignition, so that the combustible-air pre-mixture (4) continues its trajectory along the length of the first Venturi tube (104) and is expelled through the exit (103) of the first Venturi tube (104), said combustible-air pre-mixture (4) is homogenized in the proximal vicinity of the exit (223) of the first Venturi tube (104), upon flowing out from the same and colliding against the lower concave surface (401) of the central cover lid (40) which forms part of the first mixture chamber (123), where the first combustible-air mixture (9) takes place at a second velocity in order to decelerate or decrease the energy of the mixture, and is distributed uniformly through the first distribution channel (106) at a second velocity to exit through the main central combustion ports (117), said first combustible-air mixture (9) presents a sufficient uniformity to be able to carry out an adequate flame dart ignition, said second velocity being lesser than the first velocity, in turn the spark plug (not shown) emits a spark, which comes into contact with the first combustible-air mixture (9) which exits through the main central combustion ports (117) to ignite it and create the central ring of flames, this flame dart extends in a radial manner to the remaining main central combustion ports by means of a flame ring (119) formed by the circumferential groove (118), the mass of the combustible-air mixture which is burnt in the flame darts is the same as that which is distributed in the distribution channel (106), similarly, the exit velocity of the first combustible-air mixture (9) is determinant for the length of flame dart which is formed at the main central combustion ports (117), if the combustible-air mixture (9) were to not decrease its velocity from a first velocity to a second velocity, the flame dart would completely detach from said central burner (10).

If, on the other hand, one wished to work with three ring flames, activatation of said multiple selection valve (not shown) for a second time would occur, in such a way that it allows the flow of combustible towards the second Venturi tube (224), given the difference in velocities of said combustible, primary air (1) from the surroundings is dragged towards the inner part of said second Venturi tube (224), forming a second combustible-air pre-mixture (5), which presents a turbulent flow which exits at a first velocity, which itself is not sufficiently uniform to carry out an adequate dart flame ignition, so that the second combustible-air pre-mixture (5) continues its trajectory along the length of the second Venturi tube (224) and is expelled through the exit (223) of the second Venturi tube (224), said second combustible-air pre-mixture (5) is homogenized in the proximal vicinity of the exit (224) of the second Venturi tube (224), upon flowing out from the same and colliding against the lower concave surface (501) of the toroidal cover lid (50) which forms part of the second mixture chamber (237), where the second combustible-air mixture (10) takes place at a second velocity in order to decelerate or decrease the energy of the mixture, and enters the barrier rails (225, 228), which help decrease the energy of the mix to avoid flame detachment in the combustion ports nearby to the mixture chamber (237), afterwards it is distributed through the distribution channel (205) to exit through the main inner peripheral combustion ports (2191) and the main outer peripheral combustion ports (2192), said second mixture (10) presents the sufficient uniformity to undertake an adequate dart flame ignition, the second velocity being lower than the first velocity, the second combustible-air mixture (10) which exits through the main inner peripheral combustion ports (2191) is ignited given the contact between the final combustible-air mixture with a flame dart emanating from one of the main central combustion ports (117), once said flame dart is formed in the main inner peripheral combustion port (2191), this flame dart extends in a radial manner to the remaining main inner peripheral combustion ports (2191) by means of secondary inner peripheral combustion ports (2211), afterwards, a flame is transferred to the stability and transfer chamber (232), which then transfers the flame from the inner crenellated wall (203) towards the outer crenellated wall (204), igniting a flame dart on one of the main outer peripheral combustion ports (2192), this flame dart extends in a radial manner to the remaining main outer peripheral combustion ports (2192) by means of secondary outer peripheral combustion ports (2212), the mass of the second combustible-air mixture (10) which is burnt in the flame darts is the same as that which is formed in the second mixture chamber (237), similarly, the exiting velocity of the second combustible air mixture (10) is determinant for the length of the flame dart which is formed at the main inner and outer peripheral combustion ports, if the second combustible-air mixture (10) were to not decrease its velocity from a first velocity to a second velocity, the flame dart would completely detach from said double ring toroidal burner.

If one wished to only work with the intermediary and outer flame rings, the selection valve would be activated for a third time in such a way that it cut the supply of combustible to the first Venturi tube (104), turning off the central flame ring.

In an alternative embodiment, the spark plug (not shown) is found set in close proximity to the main outer peripheral combustion ports (2192), once said flame dart is formed at the main outer peripheral combustion ports (2192), this flame dart extends in a radial manner to the remaining main outer peripheral combustion ports (2192) by means of secondary outer peripheral combustion ports (2212), afterwards, a flame is transferred to the stability and transfer chamber (232), which then transfers the flame from the outer crenellated wall (204) towards the inner crenellated wall (203), igniting a flame dart on one of the main inner peripheral combustion ports (2191), this flame dart extends in a radial manner to the remaining main inner peripheral combustion ports (2191) by means of secondary inner peripheral combustion ports (2211).

In a second alternative embodiment there is no spark plug, so that the flame dart is ignited by means of the contact with an outer flame, which emanates from a lighter, a match etc.

Said double ring toroidal flame burner is found installed unto a household appliance, as could be a household stove, an industrial stove, a grill etc.

Alterations to the structure hereby described for the present invention can be foreseen by those persons skilled in the art. However, it must be understood that present description is related with the preferred embodiments of the invention, which is merely for illustrative purposes and must not be construed as a limitation of present invention.

The invention claimed is:

1. A triple ring flame burner comprising:

a central burner with a central cover lid and a toroidal burner with a toroidal cover lid, wherein the central burner is coupled to the toroidal burner by at least one bridge;

said central burner comprising:

a first Venturi tube which receives and emits a first combustible-air pre-mixture for the central burner;

a first mixture chamber which receives said first pre-mixture and homogenizes it, creating a first combustible-air mixture;

a first distribution channel for distributing the first combustible-air mixture to a plurality of central combustion ports of said central burner;

a circumferential groove set on said plurality of main central combustion ports for forming a flame ring;

said toroidal burner comprises:

a second Venturi tube which receives and emits a second combustible-air premixture;

a second mixture chamber which receives said second pre-mixture and homogenizes it, creating a second combustible-air mixture;

a second distribution channel for distributing the second mixture;

an inner crenellated wall and an outer crenellated wall, said crenellated walls separated by the second distribution channel and with at least main combustion ports and secondary combustion ports;

at least one inner barrier rail, adjacent said second mixture chamber on the adjoining surfaces of said Venturi tube where the combustible-air mixture emanates from the second Venturi tube, with inner rail combustion ports shaped over the inner crenellated wall and at least one outer barrier rail with outer barrier rail combustion ports shaped over the outer crenellated wall; wherein said inner and outer barrier rails the energy of the combustible-air mixture are dissipated to result in the particles of said combustible-air mixture that enter said inner and outer barrier rail combustion ports have a lower velocity promoting adequate ignition;

a stability and flame transfer chamber with a pair of radial walls which divide the distribution channel from the inner crenellated wall until the outer crenellated wall, said radial walls present a plurality of transversal grooves which form combustion ports for the transfer of flame inserted within said radial walls, said radial walls present inner and outer ends, the inner end being in connection with a peripheral crenel for inner stability and transfer and the outer end being in connection with at least one peripheral crenel for outer stability and transfer.

2. The triple ring flame burner according to claim 1, further comprising a central crenellated wall, wherein the central crenellated wall comprises three sections, a first section (108) which is substantially vertical and which extends from a back wall (107) of the first distribution channel (106), a second section (109) which is inclined outwardly and upwardly from the highest part of the first vertical section (108), and a third section (110) which is curved and extends outwardly and downwardly from the highest point of the second inclined section (109), said third curved section (110) extends up to an intermediary point between the back wall (107) of the first distribution channel (106); and the highest point of the first vertical section (108).

3. The triple ring flame burner according to claim 1, wherein first Venturi tube (104) comprises an exit (103) that extends to a height under the highest point of the central crenellated wall (105).

4. The triple ring flame burner according to claim 3, wherein said exit (103) of the first Venturi tube (104) comprises an outer horizontal section (112) and an inner flared section (113).

5. The triple ring flame burner according to claim 1, wherein the central cover lid (40) presents a concave lower surface (401) which defines an upper limit for the central mixture chamber (106), said concave lower surface (401) presents a transition zone (402) towards a first peripheral wall (403) inclined downwardly and outwardly, a plane border (404) at the end of said peripheral wall (403), a second peripheral wall (405) inclined outwardly and upwardly from the plane border (404), a second transition zone (406) between the second peripheral wall (405) and an upper convex surface (408).

6. The triple ring flame burner according to claim 1, wherein the outer crenellated wall (204) comprises three sections, a first section (207) substantially vertical which extends from a back wall (206) of the second distribution channel (205), a second section (208) inclined outwardly and upwardly from the highest part of the first vertical section (207), and a third curved section (209) which extends outwardly and downwardly from the highest point of the second inclined section, said third curved section (209) which extends outwardly and downwardly to a point underneath the inner surface of the back wall (206) of the second distribution channel (205), said third curved section (209) presents at least one circumferential groove (2091) which increases the feeding of secondary air to the flame.

7. The triple ring flame burner according to claim 1, wherein the inner crenellated wall (203) comprises four sections, a first section (210) which is substantially vertical and which extends from the back wall (206) of the second distribution channel (205), a second section (211) inclined outwardly and upwardly from the highest point of the first section (210) which is substantially vertical, a third inclined section (212) which extends outwardly and upwardly from the highest point of the second section (211) inclined up to a point which is above the highest point of the first section (210) and a fourth vertical section (213) which extends downwardly from the lowest point of the third section (212) which is inclined and up to a point above the highest point of the first section (210).

8. The triple ring flame burner according to claim 1, wherein the combustion ports are divided into main inner peripheral combustion ports (2191) and main outer peripheral combustion ports (2192) depending on the arrangement thereof, whether it be on the inner crenellated wall (203) or on the outer crenellated wall (204).

9. The triple ring flame burner according to claim 1, wherein an adjoining surface (223) of the second Venturi tube (224) where the inner barrier rail (225) is located further comprises: a first circumferential groove (226) concentric to the second distribution channel (205) in the second section (208) of said inner crenellated wall (203) which is found in fluid communication solely with a pair of main inner peripheral combustion ports (2191) on the sides of said first groove (226), similarly, said first groove (226) presents a wall (2261) which avoids the direct ingress of the combustible-air mixture (10) into said inner barrier rail (225), said first circumferential groove (226), presents a plurality of radial grooves which come out of said inner segment (203), forming a plurality of inner barrier rail combustion ports (227) through which a part of the combustible-air mixture (10) is ignited once it has lost energy in said inner barrier rail; said inner barrier rail (225) which comprises a second circumferential groove (229) concentric to the distribution channel (205) thereby forming a wall (2291) which separates a second circumferential groove (229) from the distribution channel (205); along the length of said second circumferential groove (229) a radial groove is found at each end of said circumferential groove, as well as at least one radial groove between said end radial grooves, which come out of the outer crenellated wall (204), forming a plurality of combustion ports on the outer barrier rail (230); a plurality of communication grooves (231) which communicate a second circumferential groove (229) with the distribution channel (205), the plurality of combustion ports for an outer barrier rail (230) are found unaligned with the communication grooves (231).

10. The triple ring flame burner according to claim 1, wherein the toroidal cover lid (50) comprises a horizontal lower plane surface (501) which defines an upper limit for the peripheral mixture chamber (205) and a curved upper surface (502), which presents an upper point (503) in close proximity to the outer end (504) of said cover lid, a first curvature (505) which extends from the upper point (503) towards the outer end (504) of the cover lid (50) and a second curvature (506) which extends from the upper point (503) towards the inner end (507) of the cover lid (50), a radius of the second curvature (506) being greater than that of the first curvature (505); an outer end (504) of the cover lid (50) extends above from an inner end (507) of the cover lid; similarly the lower plane surface (501) joins with the inner end (507) of the cover lid (50) by means of a first rounded bevel (508), the outer end (504) of the cover lid (50) presents a protuberance (509) with a substantially horizontal plane lower end (510), which itself joins with the lower plane surface (501) by means of a bevel (511); the main function of said protuberance (509) with the substantially horizontal plane lower end (510) is that of anchoring the flame dart to the burner.

11. The triple ring flame burner according to claim 1, wherein a height of the main peripheral inner combustion ports (2191) is lower than the height of the main central combustion ports (117), given that if it were identical, given the velocity at which the combustible air mixture exits from said combustion ports, a turbulence would be created which would not allow that the combustible-air mixture emanating form said main inner combustion ports and the main central combustion ports would be able to ignite.

12. The triple ring flame burner according to claim 8, wherein some of the main outer peripheral combustion ports (2191) present a third depth in order to form tertiary peripheral combustion ports (2193), said third depth being lesser than the first depth, but greater than the second depth of the secondary peripheral combustion ports, so that the amount of heat emitted by the flame dart produced by said tertiary outer peripheral combustion ports (2193) will be much lesser than that produced by main peripheral combustion ports, the layout of said tertiary outer peripheral combustion ports (2193) will vary.

* * * * *